US007992969B2

(12) United States Patent
Tanaka et al.

(10) Patent No.: US 7,992,969 B2
(45) Date of Patent: Aug. 9, 2011

(54) PIEZOELECTRIC ACTUATOR, LIQUID-DROP EJECTING HEAD, AND LIQUID-DROP EJECTING APPARATUS

(75) Inventors: Shinji Tanaka, Atsugi (JP); Manabu Nishimura, Kobe (JP)

(73) Assignee: Ricoh Company, Ltd., Tokyo (JP)

( * ) Notice: Subject to any disclaimer, the term of this patent is extended or adjusted under 35 U.S.C. 154(b) by 169 days.

(21) Appl. No.: 12/468,965

(22) Filed: May 20, 2009

(65) Prior Publication Data

US 2009/0289998 A1 Nov. 26, 2009

(30) Foreign Application Priority Data

May 20, 2008 (JP) ..... 2008-131589
Jul. 9, 2008 (JP) ..... 2008-179524

(51) Int. Cl.
*B41J 2/045* (2006.01)

(52) U.S. Cl. ..... 347/68

(58) Field of Classification Search ..... 347/68, 347/69, 70–72; 400/124.14, 124.16; 310/311, 310/324, 327
See application file for complete search history.

(56) References Cited

U.S. PATENT DOCUMENTS

| | | | |
|---|---|---|---|
| 6,511,158 | B2 | 1/2003 | Tanaka |
| 6,592,208 | B2 | 7/2003 | Tanaka |
| 6,877,841 | B2 | 4/2005 | Tanaka |
| 6,986,567 | B2 | 1/2006 | Tanaka |
| 7,033,002 | B2 | 4/2006 | Tanaka |
| 7,287,841 | B2 | 10/2007 | Tanaka |
| 7,416,281 | B2 | 8/2008 | Nishimura et al. |
| 2006/0132547 | A1 | 6/2006 | Sugahara |
| 2007/0046736 | A1 | 3/2007 | Katayama et al. |
| 2008/0074475 | A1 | 3/2008 | Katayama |

FOREIGN PATENT DOCUMENTS

| | | |
|---|---|---|
| EP | 1671797 A1 | 6/2006 |
| JP | 10-217466 | 8/1998 |
| JP | 2003-8091 | 1/2003 |
| JP | 2005-92987 | 4/2005 |
| JP | 3750709 | 12/2005 |
| JP | 2007-139841 | 6/2007 |

OTHER PUBLICATIONS

Sep. 22, 2009 European search report in connection with a counterpart European patent application No. 09 25 1332.

*Primary Examiner* — K. Feggins
(74) *Attorney, Agent, or Firm* — Cooper & Dunham LLP

(57) ABSTRACT

A liquid drop ejecting head for ejecting liquid drops from nozzles communicating with liquid chambers includes a piezoelectric actuator including a diaphragm whose ends are fixed in a short-side direction of the diaphragm and an active element mounted on the diaphragm. The active element is contractible and extendable by a supply of a voltage to displace the diaphragm in an out-of-plane direction. The diaphragm is displaced with curvature so as to have a plurality of inflection points in the short-side direction. The active element is disposed in at least one area of an area from each of the ends of the diaphragm to a proximal inflection point of the inflection points and an area from one inflection point to another neighboring inflection point of the inflection points in a cross-section in the short-side direction of the diaphragm.

17 Claims, 21 Drawing Sheets

FIG. 23A
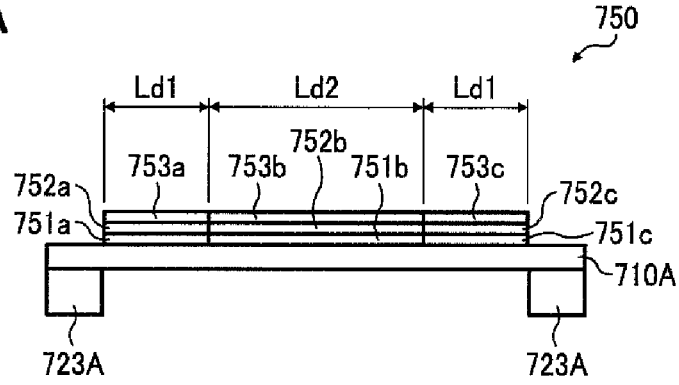
FIG. 23B
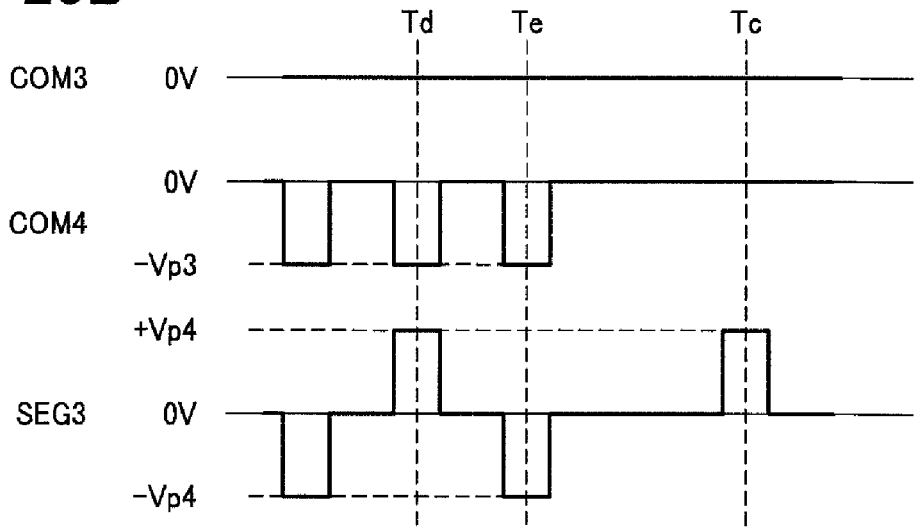
FIG. 23C
| | case0 | case1 | case2 |
|---|---|---|---|
| FL1 | 0 | 1.E-04 | 1.E-04 |
| FL2 | 1.E-04 | -1.E-04 | 1.E-04 |
| δ (μm) | 0.216766 | 0.424756 | 0.023568 |

PIEZOELECTRIC ACTUATOR, LIQUID-DROP EJECTING HEAD, AND LIQUID-DROP EJECTING APPARATUS

CROSS-REFERENCE TO RELATED APPLICATIONS

The present patent application claims priority pursuant to 35 U.S.C. §119 from Japanese Patent Application Nos. 2008-131589, filed on May 20, 2008, and 2008-179524, filed on Jul. 9, 2008 in the Japan Patent Office, the entire contents of each of which are hereby incorporated herein by reference.

BACKGROUND

1. Technical Field

This disclosure relates to a piezoelectric actuator, a liquid-drop ejecting head including the piezoelectric actuator, and a liquid-drop ejecting apparatus including the liquid drop ejecting head.

2. Description of the Background

Recently, piezoelectric actuators including piezoelectric bodies have come to be used to drive micro devices. There continues to be demand for downsizing such actuators used for micro devices, and likewise the downsizing of such piezoelectric actuators is required.

Conventionally, a multilayer piezoelectric element in which a piezoelectric material is sandwiched between a plurality of electrodes is widely used in a piezoelectric actuator. Although such a multilayer piezoelectric element can provide a large amount of deformation, which is generally desirable, such a multilayer structure may pose a disadvantage in terms of downsizing of a micro device. Further, producing a multilayer piezoelectric element may require high-level processing technologies such as cutting the bulk of piezoelectric elements. Compared to such a multilayer piezoelectric element, a piezoelectric element made of thin film PZT (lead zirconate titanate) has an advantage in terms of downsizing. For this reason, some types of piezoelectric actuators use thin film PZT.

FIGS. 1A to 1C are schematic views illustrating a conventional piezoelectric actuator 510 using thin film PZT. FIG. 1A is a perspective view illustrating a schematic configuration of the conventional piezoelectric actuator 510. FIG. 1B is a sectional view illustrating the piezoelectric actuator 510 cut along a line A-A. FIG. 1C is a sectional view illustrating the piezoelectric actuator 510, which is cut along the line A-A, observed when a diaphragm 511 of the piezoelectric actuator 510 is displaced.

The piezoelectric actuator 510 includes the diaphragm 511 and a piezoelectric element 512 formed of thin film PZT. The piezoelectric element 512 is formed on one face of the diaphragm 511. A first electrode 513 is formed between the diaphragm 511 and the piezoelectric element 512. A second electrode 514 is formed on a face of the piezoelectric element 512 opposite a face on which the piezoelectric element 512 contacts the diaphragm 511. The first electrode 513 and the second electrode 514 are supplied with voltages as illustrated in FIG. 2, illustrating examples of voltages supplied to the electrodes 513 and 514. In FIG. 2, the electrode 513 is supplied with a ground potential while the electrode 514 is supplied with a driving potential Vp for driving the piezoelectric element 512.

In the piezoelectric actuator 510, the piezoelectric element 512 is formed at a middle portion of the diaphragm 511. As illustrated in FIG. 1C, when a driving voltage is supplied to the electrode 514, the piezoelectric element 512 extends and contracts the opposed faces of the diaphragm 511 on which the piezoelectric element 512 is formed. Such a configuration allows the piezoelectric actuator 510 to obtain a large displacement amount in the out-of-plane direction of the diaphragm 511 even with the deformation of the piezoelectric element 512 itself is at a low level.

In the piezoelectric actuator 510 illustrated in FIGS. 1A to 1C, forming the piezoelectric element 512 at the middle portion of the diaphragm 511 can provide a larger displacement amount in the out-of-plane direction of the diaphragm 511. However, for example, if the piezoelectric element 512 is provided over a whole area of one face of the diaphragm 511, the displacement amount in the out-of-plane direction of the diaphragm 511 may be reduced. This is because the whole area of one face of the diaphragm 511 extends and contracts in response to the extension and contraction of the piezoelectric element 512 to prevent deformation of the diaphragm 511. Thus, the higher the degree of integration of the piezoelectric actuator 510, the smaller the width of the diaphragm 511, and the less the diaphragm 511 is deformed.

In such a state, to obtain a larger displacement amount in the out-of-plane direction requires supplying a larger driving voltage to the piezoelectric element 512. However, the larger the driving voltage supplied to the piezoelectric element 512, the more likely the piezoelectric element 512 is to receive damage due to ion migration. Such ion migration may be caused by electrode metal ionized and eluted when moisture in air causes an electrochemical reaction. In particular, the pace of ion migration tends to increase at temperatures of 100° C. or less, current densities of 1 mA/cm$^2$ or less, and/or relatively high humidity. The higher the electric-field intensity, the shorter the breaking time of ion migration. As a result, without any measures take to prevent the effect of humid air, electronic components supplied with high voltage might more easily fail. Further, when Nox, NH3, and Cl in the air are adhered to drops, ion migration is accelerated. Therefore, if an electronic component remains exposed to air, oxidization, salination, and sulfuration may easily arise in the electronic component, resulting in ion migration. Thus, ion migration more easily arises in the piezoelectric actuator 510 supplied with high driving voltage.

Hence, various attempts have been made to enhance the degree of integration and increase the displacement amount in the out-of-plane direction of the diaphragm without increasing the driving voltage.

For example, in one conventional approach, to increase the displacement amount of a diaphragm, a piezoelectric element is divided in the short direction of the diaphragm so that the extension and contraction of the diaphragm in the in-plane direction are opposite the extension and contraction in the out-of-plane direction. However, in the above-described approach, each actuator requires two individual electrodes in addition to a common electrode. Accordingly, the number of components, such as driving drivers, may increase, resulting in increased cost.

In another conventional approach, the electrode is divided into a plurality of pieces in each piezoelectric actuator, and the divided pieces are connected between a plurality of piezoelectric actuators to form a common electrode. However, with this configuration two pulses different in timing are required to increase the displacement amount of the diaphragm, which is not conducive to high-speed driving.

Further, a conventional piezoelectric actuator is known that displaces a diaphragm having fixed ends in the short direction by supplying voltages to piezoelectric bodies disposed between opposing electrodes. In such a conventional piezoelectric actuator, for example, separate opposed electrodes are disposed at a middle portion and peripheral portions of a diaphragm in a cross-section of the diaphragm in the short direction. Further, voltages of different polarities are supplied to the piezoelectric bodies so that the extension and contraction of the piezoelectric bodies become opposite between the middle portion and the neighboring portion.

However, in the above-described conventional piezoelectric actuator, since the piezoelectric bodies are provided all over one face of the diaphragm, the piezoelectric bodies disposed at areas in which the opposing electrodes are not provided may reduce the displacement of the diaphragm, effectively preventing an increase in the displacement amount of the diaphragm.

In another conventional piezoelectric actuator, piezoelectric bodies and electrodes on one face of the respective piezoelectric bodies are separately disposed at middle and peripheral portions in the cross-section of a diaphragm in the short direction. However, although the piezoelectric bodies are provided at the middle and peripheral portions of the diaphragm, the displacement of the diaphragm may be reduced depending on the positions of the piezoelectric bodies, effectively preventing any increase in the displacement amount of the diaphragm.

BRIEF SUMMARY

In an aspect of this disclosure, there is provided a piezoelectric actuator capable of effectively increasing the displacement amount of a diaphragm without reducing the displacement of the diaphragm, a liquid-drop ejecting head including the piezoelectric actuator, and a liquid-drop ejecting apparatus including the liquid-drop ejecting head.

In another aspect, a liquid drop ejecting head for ejecting liquid drops from nozzles communicating with liquid chambers includes a piezoelectric actuator including a diaphragm whose ends are fixed in a short-side direction of the diaphragm and an active element mounted on the diaphragm. The active element is contractible and extendable by a supply of a voltage to displace the diaphragm in an out-of-plane direction. The diaphragm is displaced with curvature so as to have a plurality of inflection points in the short-side direction. The active element is disposed in at least one area of an area from each of the ends of the diaphragm to a proximal inflection point of the inflection points and an area from one inflection point to another neighboring inflection point of the inflection points in a cross-section in the short-side direction of the diaphragm.

In another aspect, a liquid drop ejecting head includes a plurality of piezoelectric actuators including a deformable diaphragm of a substantially rectangular shape, a first electrode formed on a face of the diaphragm, a piezoelectric layer formed on a first face of the first electrode opposite a second face of the first electrode contacting the diaphragm, and a second electrode formed on a first face of the piezoelectric layer opposite a second face of the piezoelectric layer contacting the first electrode and divided into three portions in a cross-section in a short-side direction of the diaphragm. A first common potential is supplied to the first electrode of the plurality of piezoelectric actuators. A control potential is supplied to a portion located between the other two portions out of the three portions of the second electrode. A second common potential is supplied to the other two portions.

In another aspect, a liquid drop ejecting apparatus includes a liquid drop ejecting head with a plurality of piezoelectric actuators. The plurality of piezoelectric actuators includes a deformable diaphragm of a substantially rectangular shape, a first electrode formed on a face of the diaphragm, a piezoelectric layer formed on a first face of the first electrode opposite a first face of the first electrode contacting the diaphragm, and a second electrode formed on a first face of the piezoelectric layer opposite a second face of the piezoelectric layer contacting the first electrode and divided into three portions in a cross section in a short-side direction of the diaphragm. A first common potential is supplied to the first electrode of the plurality of piezoelectric actuators. A control potential is supplied to a portion located between the other two portions of the three portions of the second electrode. A second common potential is supplied to the other two portions.

BRIEF DESCRIPTION OF THE DRAWINGS

A more complete appreciation of the aforementioned and other aspects, features and advantages will be readily acquired as the same becomes better understood by reference to the following detailed description when considered in connection with the accompanying drawings, wherein:

FIG. 23A is a schematic view illustrating a piezoelectric actuator designed for simulation;

FIG. 23B is a diagram illustrating driving voltages during simulation;

FIG. 23C is a table showing results of simulation;

Figure 1A:
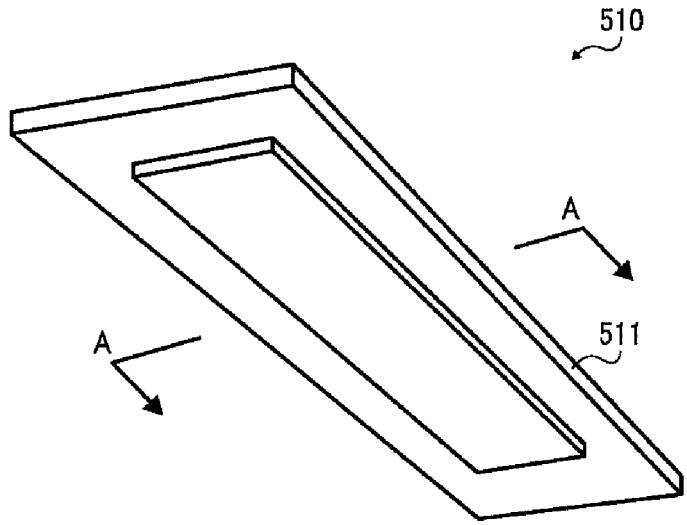
FIGS. 1A to 1B are schematic views illustrating a conventional piezoelectric actuator employing thin-film PZT.

The accompanying drawings are intended to depict illustrative embodiments of the present disclosure and should not be interpreted to limit the scope thereof. The accompanying drawings are not to be considered as drawn to scale unless explicitly noted.

DETAILED DESCRIPTION OF ILLUSTRATIVE EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the illustrative embodiments are described with technical limitations with reference to the attached drawings, such description is not intended to limit the scope of the present invention and all of the components or elements described in the illustrative embodiments of this disclosure are not necessarily indispensable to the present invention.

First, an illustrative embodiment is described with reference to FIGS. 3 to 10B. Below, an image forming apparatus 81 according to the present illustrative embodiment is described as a printer. However, it is to be noted that an image forming apparatus according to the present embodiment is not limited to the printer and may be any suitable type of image forming apparatus.

Figure 3:
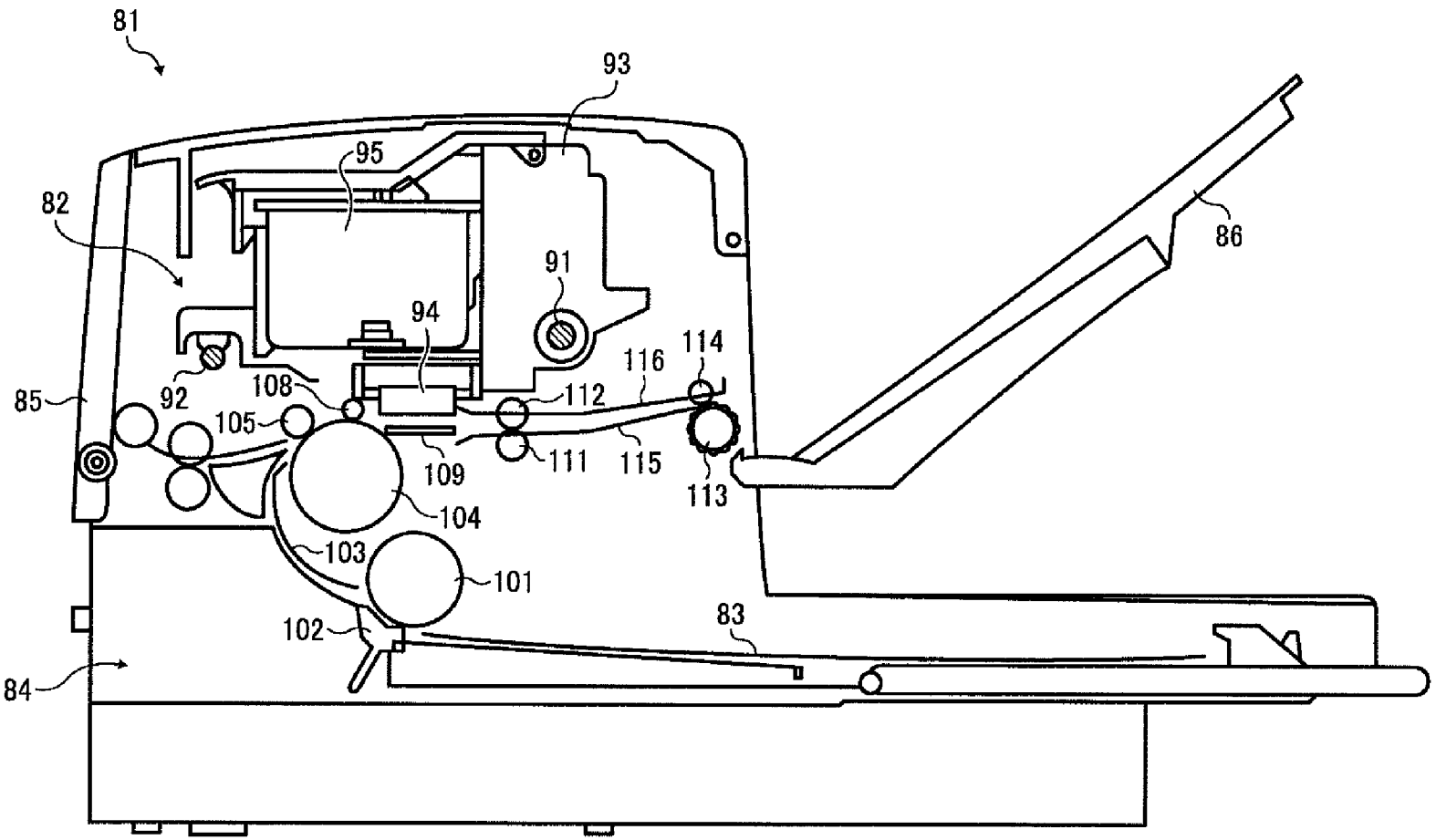
FIG. 3 is a vertical cross-sectional view illustrating a schematic configuration of an image forming apparatus according to an illustrative embodiment.

As illustrated in FIG. 3, the image forming apparatus 81 includes a recording unit 82 to record an image on a sheet 83 by ejecting ink, a sheet feed cassette 84 and a manual feed tray 85 to load sheets to be fed to the recording unit 82, and an output tray 86 to output a sheet on which the image is formed in the recording unit 82.

The recording unit 82 includes a liquid-drop ejecting head 94, a carriage 93 movable in a main scan direction, and an ink cartridge 95 that supplies ink to the liquid-drop ejecting head 94.

Figure 4:
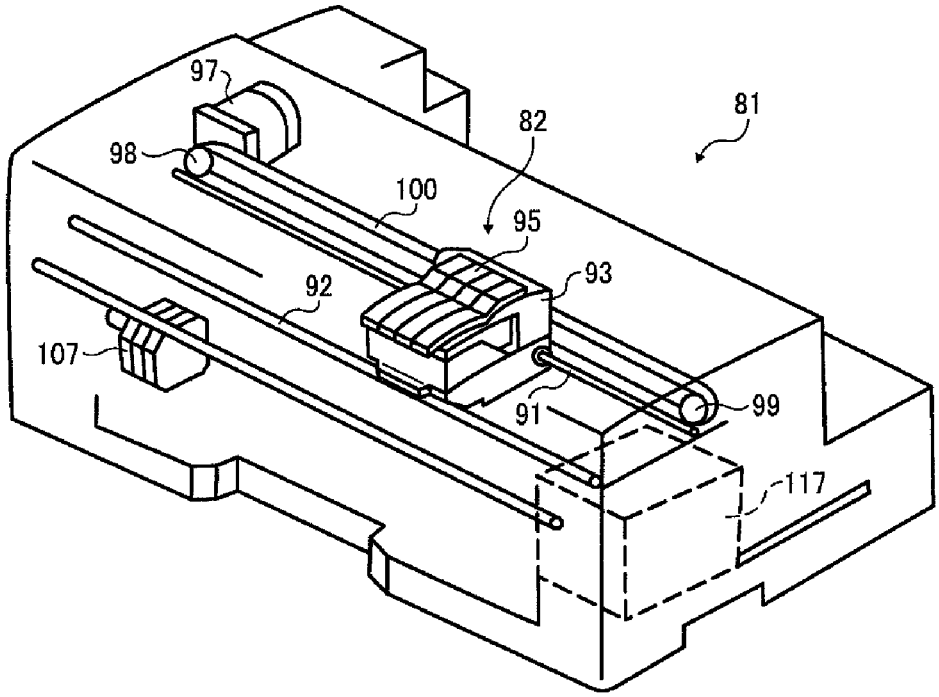
FIG. 4 is a perspective view illustrating the image forming apparatus illustrated in FIG. 3.

As illustrated in FIG. 4, the carriage 93 is slidably held with a main guide rod 91 and a sub guide rod 92, which are supported by side plates of the image forming apparatus 81. Liquid-drop ejecting heads 94 for ejecting respective ink drops of yellow (Y), cyan (C), magenta (M), and black (Bk) are installed in the carriage 93 so that such ink drops are ejected downward. A plurality of nozzle orifices (ink ejection openings) 65 are arranged in a direction perpendicular to the main scan direction of each of the liquid-drop ejecting heads 94. The liquid-drop ejecting heads 94 eject ink drops using a so-called side shooter method in which the orientation of ink channel differs from the orientation of nozzle orifice 65.

Figure 5:
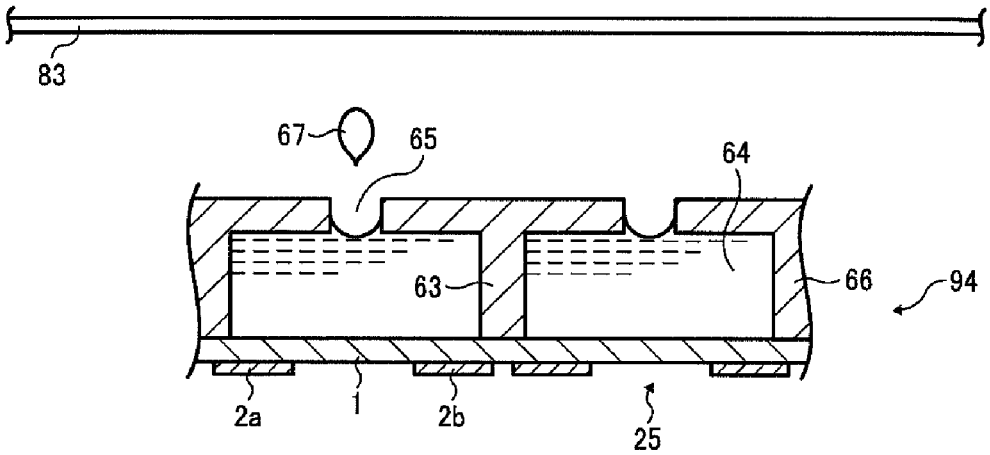
FIG. 5 is a vertical cross-sectional view illustrating a liquid-drop ejecting head according to an illustrative embodiment.

As illustrated in FIG. 5, each liquid-drop ejecting head 94 includes a piezoelectric actuator 25 and liquid chambers 64 communicated with the nozzle orifices 65.

For the piezoelectric actuator 25, by supplying voltages to first and second piezoelectric elements (active elements) 2*a* and 2*b*, the first and second piezoelectric elements 2*a* and 2*b* are deformed to displace the diaphragm 1 in the out-of-plane direction.

The diaphragm 1 constitutes a bottom wall (wall face) of the liquid chambers 64, and the nozzle orifices 65 are formed in a wall 66 of the liquid chamber 64 facing the diaphragm 1. For the liquid-drop ejecting heads 94, by displacing the diaphragm 1, the pressure of ink in the liquid chamber 64 is changed to eject ink drops 67 are ejected onto a sheet (recording medium) 83. In each liquid-drop ejecting head 94, the plurality of liquid chambers are partitioned with walls 63, and the piezoelectric actuator 25 is provided to each of the liquid chambers 64.

Next, a description is given of a method of manufacturing the piezoelectric actuator 25 with reference to FIGS. 6A to 6E.

Figure 6A:
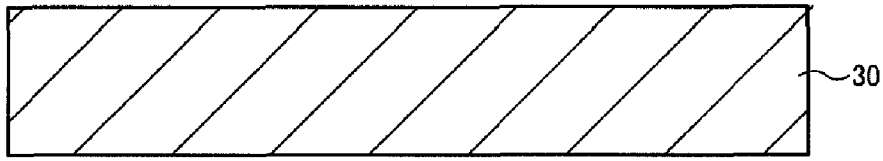
FIGS. 6A to 6E are a cross-sectional flow diagram of the piezoelectric actuator.
Figure 6B:
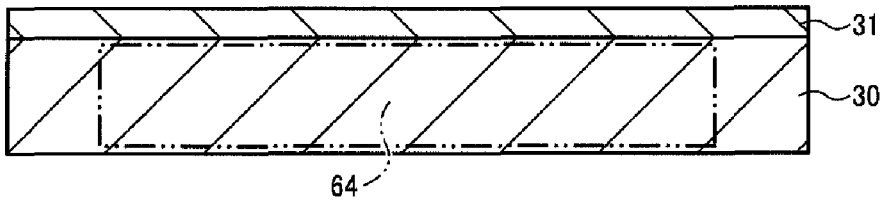
Figure 6C:
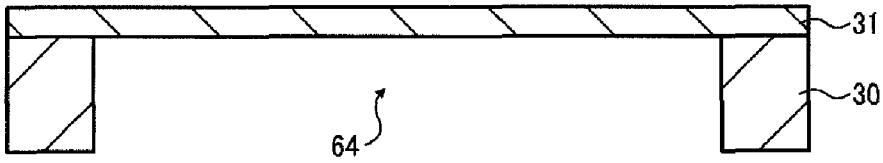
Figure 6D:
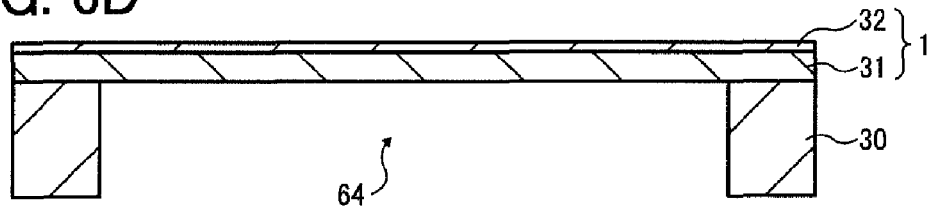
Figure 6E:
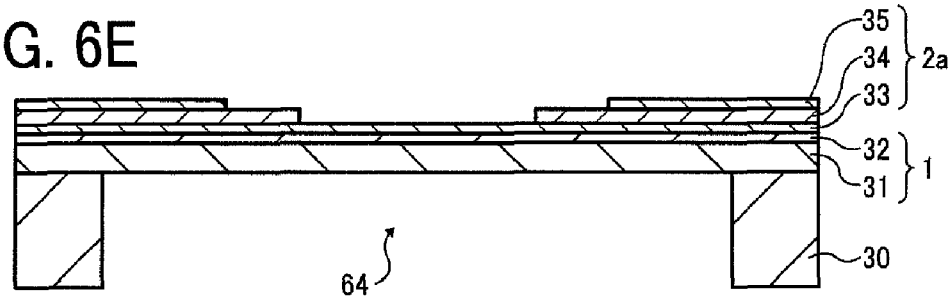

Concentrated boron (B) is injected into a face of a Si substrate 30 (see FIG. 6A) in a time-controlled manner to form a high-concentration boron layer 31 having a thickness of about 2 μm (see FIG. 6B). Next, on a face opposite the high-concentration boron layer 31 of the Si substrate 30, a first $SiO_2$ layer is formed using a chemical vapor deposition (CVD) method, and a portion of the first $SiO_2$ layer corresponding to a liquid chamber 64 of the liquid-drop ejecting head 94 is removed. Further, using KOH, a portion of the Si substrate 30 corresponding to the liquid chamber 64 (i.e., a portion demarcated by broken lines in FIG. 6B) is etched into the high-concentration boron layer 31 (see FIG. 6C). On an upper face of the high-concentration boron layer 31, a second $SiO_2$ layer 32 is formed to form the diaphragm 1 (see FIG. 6D). As illustrated in FIG. 6E, a first electrode layer 33, a piezoelectric layer 34, and a second electrode layer 35 are deposited one after another to form the piezoelectric actuator 25.

Figure 7:
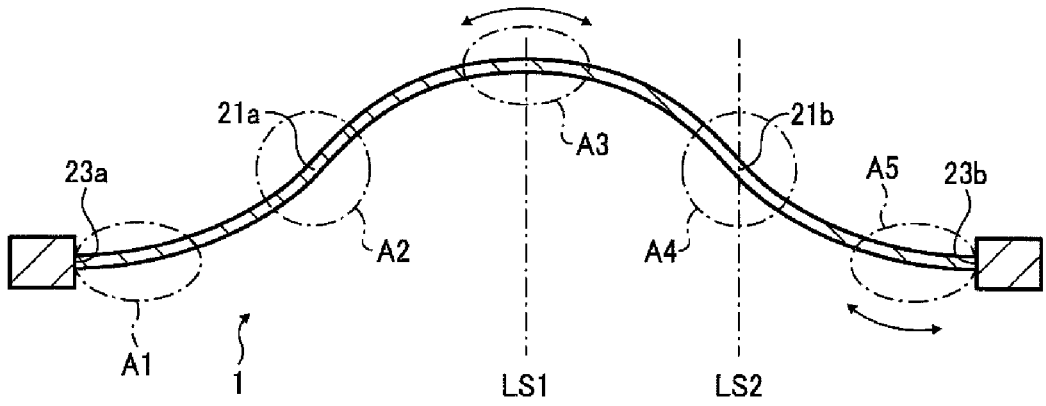
FIG. 7 is a vertical cross-sectional view illustrating a displaced cross-section in a short direction of a diaphragm of the piezoelectric actuator.

FIG. 7 is a schematic cross-sectional view of a piezoelectric actuator 25 in the short direction of a diaphragm 1 observed when the diaphragm 1 is vibrated in a first vibration mode. At rest, the diaphragm 1 has a substantially rectangular shape similar to the shape illustrated in FIG. 1A, and the above-described cross section in the short direction of the diaphragm 1 is similar to the cross section A-A illustrated in FIG. 1A. In action, that is, when vibrated in the first vibration mode, the diaphragm 1 takes the shape illustrated in FIG. 7, depending on such factors as the distribution of an applied load, the distribution of thickness of the diaphragm 1, and so on.

When the diaphragm 1 whose ends are fixed in the short direction vibrates in the first vibration mode, the cross section in the short direction of the diaphragm 1 may have a shape like that illustrated in FIG. 7. In FIG. 7, some portions of the diaphragm 1 are more strongly bent than peripheral portions, and applying active forces to such portions can increase the displacement amount of the entire diaphragm 1. Here, a strong bend means a small curvature radius, and in FIG. 7, for example, areas A1, A3, and A5 have relatively small curvature radii including a minimum curvature radius. Accordingly, the piezoelectric elements 2 may be formed at such small-curvature areas to bend the diaphragm 1. In this regard, the extension and contraction directions on one face of the diaphragm 1 are opposite between the area A1 and the area A3. Consequently, if piezoelectric elements 2 operating in the completely same manner are formed at the areas A1 and A3 on one face of the diaphragm 1, the displacement of the entire diaphragm 1 might be reduced or eliminated. Therefore, it is better to avoid such a configuration. By contrast, in FIG. 7, areas A2 and A4 (near inflection points) have relatively large curvature radii.

Further, in the case in which the thickness of the diaphragm 1 is uniform and the internal stress is negligible, if the displacement amount of the diaphragm 1 becomes maximum with a minimum load, the displacement shape is symmetrical with respect to a centerline LS1 of the diaphragm 1, and each half area of the diaphragm 1 is asymmetrical with respect to a line separating one quarter of the diaphragm 1.

Figure 8A:
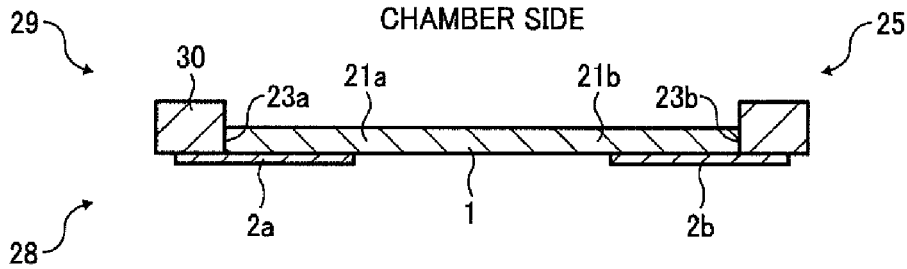
FIG. 8A is a vertical cross-sectional view illustrating a pre-displacement state of a piezoelectric actuator according to an illustrative embodiment.
Figure 8B:
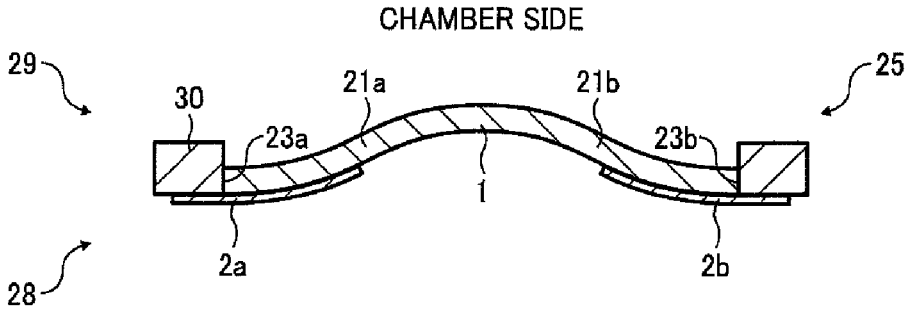
FIG. 8B is a vertical cross-sectional view illustrating a post-displacement state of the piezoelectric actuator illustrated in FIG. 8A.
Figure 9:
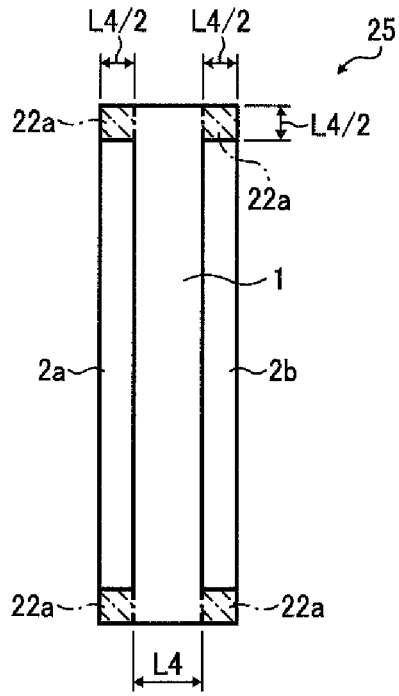
FIG. 9 is a plan view illustrating the piezoelectric actuator seen from a side opposite a liquid chamber.

As illustrated in FIGS. 8A and 8B, the first piezoelectric element 2*a* is disposed on one face 28 of the diaphragm 1 and over an area from one end 23*a* of the diaphragm 1 to a proximal inflection point 21*a* in the cross section bent and displaced in the short direction of the diaphragm 1. The second piezoelectric element 2*b* is disposed on the one face 28 of the diaphragm 1 and over an area from the other end 23*b* of the diaphragm 1 to a proximal inflection point 21*b* in the cross section bent and displaced in the short direction of the diaphragm 1. In other words, the first piezoelectric element 2*a* is disposed so as to include an area A1 illustrated in FIG. 7 at which the curvature radius of the diaphragm 1 is a local minimum or the bent of the diaphragm 1 is relatively strong. The second piezoelectric element 2*b* is disposed so as to include an area A5 at which the curvature radius of the diaphragm 1 is a local minimum or the curve of the diaphragm 1 is relatively strong. As illustrated in FIG. 9, the first piezoelectric element 2*a* and the second piezoelectric element 2*b* are disposed across an area that excludes end portions 22*a*, which is indicated by diagonal dashed lines, in the long direction of the diaphragm 1. The long-directional end portions 22*a* are square areas located at four corners of the diaphragm 1, and in FIG. 9, where L4 represents one half of the length of the diaphragm 1 in the short direction, the length of one edge of each long-directional end portion 22*a* is represented by L4/2.

As illustrated in FIG. 4, the ink cartridges 95 to supply color ink to the liquid-drop ejecting heads 94 are detachably mounted on the carriage 93.

Each ink cartridge 95 has an air opening communicating with atmospheric air at the upper portion, a supply port to supply ink to the corresponding liquid-drop ejecting head 94 at the lower portion, and a porous body to fill the ink inside. Each ink cartridge 95 maintains ink, which is supplied to the corresponding liquid-drop ejecting head 94, at a slight negative pressure by a capillary force of the porous body. Although in the present illustrative embodiment the plurality of liquid-drop ejecting heads 94 for respective colors are employed as the recording head, it is to be noted that a single liquid-drop ejecting head having nozzle orifices for ejecting ink drops of respective colors may be employed instead.

The rear side (the downstream side in a sheet conveyance direction) of the carriage 93 slidably engages a main guide rod 91, and the front side (the downstream side in the sheet conveyance direction) is slidably placed on a sub guide rod 92. The carriage 93 scans while traveling in the main scan direction. A timing belt 100 is extended between a driving pulley 98 rotated by a main scan motor 97 and a driven pulley 99. The carriage 93 fixed at the timing belt 100 travels back and forth by positive and reverse rotations of the main scan motor 97.

Meanwhile, to convey the sheet 83 from the sheet feed cassette 84 to a position below the liquid-drop ejecting heads 94, as illustrated in FIG. 3 the image forming apparatus 81 includes a sheet feed roller 101 and a friction pad 102 to separate and feed the sheet 83 from the sheet feed cassette 84, a first guide member 103 to guide the sheet 83, a first conveyance roller 104 to reverse and convey the sheet 83, a second conveyance roller 105 to be pressed against a circumference surface of the first conveyance roller 104, and a front-end roller 106 to regulate an angle at which the sheet 83 is fed from the first conveyance roller 104. The first conveyance roller 104 is rotated by a sub-scan motor 107 via a set of gears.

The image forming apparatus 81 further includes a print receiving member 109 serving as a sheet guide member to guide the sheet 83, which is fed from the first conveyance roller 104 in accordance with a traveling range in the main scan direction of the carriage 93, at a position below the liquid-drop ejecting heads 94. At the downstream side of the print receiving member 109 in the sheet conveyance direction are provided a third conveyance roller 111 and a first spur 112 that are rotated to feed the sheet 83 in a sheet output direction, an output roller 113 and a second spur 114 to feed the sheet 83 to the output tray 86, and a third guide member 115 and a forth guide member 116 that form a sheet ejection path.

As illustrated in FIG. 4, a recovery device 117 to eliminate ejection failures of the liquid-drop ejecting heads 94 is disposed at a position outside of a recording area of the carriage 93 in the traveling direction. The recovery device 117 includes cap members, a suction member, and a cleaner. In waiting for print operation, the carriage 93 is traveled to the recovery device 117 so that the liquid-drop ejecting heads 94 are capped with the cap members. Thus, the nozzle orifices 65 remain moistened, preventing ejection failures due to dried ink. Further, during recording, ink irrelevant to the recording is ejected to maintain a substantially uniform viscosity of the ink in all nozzle orifices 65 in order to ensure stable ink ejection.

Next, a description is given of operation of the image forming apparatus 81. The sheet 83 fed from the sheet feed cassette 84 or the manual feed tray 85 is conveyed to the recording unit 82. After a desired image is recorded on the sheet 83 by the recording unit 82, the sheet 83 is output to the output tray 86.

During recording, by driving the liquid-drop ejecting head 94 in accordance with an image signal while traveling the carriage 93, ink is ejected to the sheet 83 at a stop to record one line of a desired image. Then, when the sheet 83 is fed by a certain amount (distance), ink is ejected to the sheet 83 to record another line of the desired image. When a recording end signal or a signal indicating that a rear edge of the sheet 83 has reached to the recording area is received, the recording is finished and the sheet 83 is output.

For example, when an ink ejection failure arises, the nozzle orifices 65 of the liquid-drop ejecting heads 94 are sealed with the cap members. When the suction unit suctions ink and air bubbles from the nozzle orifices 65 through a tube, the cleaner removes ink and dust adhered on the nozzle-orifice face of each liquid-drop ejecting head 94, thus preventing ink ejection failure. The suctioned ink is drained to a waste ink container disposed at a lower portion of the image forming apparatus 81 and is absorbed and held in an ink absorber of the waste ink container.

Next, a description is described of operation of the liquid-drop ejecting head 94. When voltages are supplied to the first piezoelectric element 2*a* and the second piezoelectric element 2*b* to extend them in the short direction of the diaphragm 1, as illustrated in FIG. 8B the diaphragm 1 is bent toward the liquid chamber 64. As a result, the pressure of ink in the liquid chamber 64 is increased, ejecting ink drops from the nozzle orifices 65 to the sheet 83.

TABLE 1

| Model Type | L6 or L7 or L8 (μm) | Displacement Amount |
|---|---|---|
| Comparative Example 1 | L6 = 20 | 0.0349 |
| Comparative example 2 | L6 = 25 | 0.0381 |
| Comparative example 3 | L6 = 30 | 0.0392 |
| Comparative example 4 | L6 = 35 | 0.0380 |
| Comparative example 5 | L6 = 40 | 0.0347 |
| Embodiment example 1 | L7 = 20 | 0.0351 |
| Embodiment example 2 | L7 = 30 | 0.0394 |
| Embodiment example 3 | L7 = 40 | 0.0350 |
| Embodiment example 4 | L8 = 30 | 0.0785 |

Figure 10A:
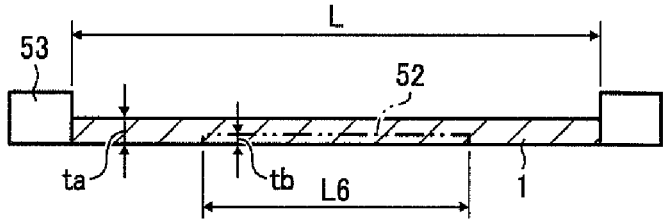
FIG. 10A is a vertical cross-sectional view illustrating a configuration of the diaphragm assumed that a piezoelectric element is disposed at a middle portion in the short direction of the diaphragm.
Figure 10B:
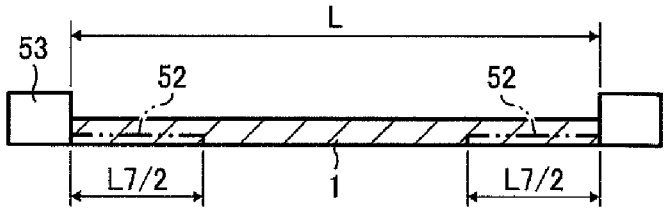
FIG. 10B is a vertical cross-sectional view illustrating a configuration of the diaphragm assumed that piezoelectric elements are disposed at peripheral portions in the short direction of the diaphragm.

Here, with reference to Table 1, a description is given of simulation results to compare the displacement amounts of the diaphragm 1 between different positions of piezoelectric elements relative to the diaphragm 1. Comparative examples 1 to 5 are a model type assumed that a piezoelectric element is disposed at a middle portion in the short direction of the diaphragm 1 as illustrated in FIG. 10A. Examples 1 to 3 according to the present illustrative embodiment (hereinafter, Embodiment examples 1 to 3) are a model type assumed that the above-described piezoelectric elements are disposed at peripheral portions in the short direction of the diaphragm 1 as illustrated in FIG. 10B.

In Comparative examples 1 to 5 and Embodiment examples 1 to 3, a description is given of a diaphragm 51, an extensible area(s) 52 capable of extending in an in-plane direction, and hold areas 53. In both the model types, the following conditions are assumed: L is 60 μm, the thickness "ta" of the diaphragm 1 is 3 μm, the thickness "tb" of the extensible area 52 is 0.5 μm, and the extensible force of the extensible area 52 in the in-plane direction is uniform. Further, the Young's modulus=210 GPa and the Poisson's ratio=0.27 are assumed in the entire area of the diaphragm 51 including the extensible area 52 of Comparative examples 1 to 5 and Embodiment examples 1 to 3. Table 1 shows displacement amounts of a middle portion of the diaphragm 51 obtained by changing L6 and L7 as parameters. Among Comparative examples 1 to 5, the displacement amount of the diaphragm 51 is maximum when L6 is 30 μm (Embodiment example 3). Meanwhile, among Embodiment examples 1 to 3, the displacement amount of the diaphragm 51 is maximum when L7 is 30 μm (Embodiment example 2). When Comparative example 1 (L6=20 μm) is compared to Embodiment example 1 (L7=20 μm) and when Comparative example 3 (L6=30 μm) is compared to Embodiment example 2 (L7=30 μm), Embodiment examples 1 and 2 are slightly larger in the displacement amount than the comparative examples 1 and 3, respectively. In Comparative example 4 (L6=35 μm), Comparative example 5 (L6=40 μm), and Embodiment example 3 (L7=40 μm), when the piezoelectric elements are disposed across the inflection points 21*a* and 21*b* of a bend of the diaphragm 1, the displacement amount of the diaphragm 1 is relatively small.

Next, a description is given of the effects of operation of the present illustrative embodiment. According to the present illustrative embodiment, as illustrated in FIG. 8B, the piezoelectric elements 2*a* and 2*b* do not cover the inflection points 21*a* and 21*b*, respectively, in a cross-section of the diaphragm 1 bent in the short direction. Such a configuration can effectively increase the displacement amount of the diaphragm 1 without reducing the displacement of the diaphragm 1.

As illustrated in FIG. 7, the first piezoelectric element 2*a* and the second piezoelectric element 2*b* are disposed on the areas A1 and A5, respectively, in which the curvature radius of the diaphragm 1 is locally minimum or the diaphragm 1 are relatively strongly bent, effectively providing a large displacement amount of the diaphragm 1.

As illustrated in FIGS. 6A to 6E, the diaphragm 1, the first piezoelectric element 2*a*, and the second piezoelectric element 2*b* can be produced according to a semiconductor production process, thus reliably providing the piezoelectric actuator 25 at a relatively low cost and a high yield rate.

The piezoelectric actuator 25 can effectively increase the displacement amount of the diaphragm 1, providing a desired pressure at a relatively compact size. Accordingly, the liquid-drop ejecting head 94 including a plurality of the piezoelectric actuators 25 can be downsized.

The first piezoelectric element 2*a* and the second piezoelectric element 2*b* are disposed on areas having identical in-plane extension and contraction characteristics in the diaphragm 1. Accordingly, when the first piezoelectric element 2*a* and the second piezoelectric element 2*b* are supplied with a voltage of the same polarity, the displacement amount of the diaphragm 1 can be effectively increased without reducing the displacement of the diaphragm 1. Accordingly, only one opposing electrode is provided for one actuator, resulting in cost reduction.

Thus, since the displacement amount of the diaphragm 1 and the generated pressure can be effectively increased, the driving voltage for obtaining a desired pressure can be lowered, resulting in cost reduction of a driver and so forth.

The liquid-drop ejecting head 94 includes the piezoelectric actuators 25 capable of effectively increasing the displacement amount of the diaphragm 1. Such a configuration can prevent ejection failure of ink drops caused by a driving failure of the diaphragm 1, ensuring stable ink ejection.

The image forming apparatus 81 includes the liquid-drop ejecting heads 94 capable of providing the above-described effects to enhance image quality.

Next, a description is given of another illustrative embodiment. Below, the same reference numerals are given to portions having substantially the same operation effect as the above-described illustrative embodiment. Therefore, redundant descriptions of such portions are omitted, and portions differing from the above-described illustrative embodiment are described below.

The present illustrative embodiment is described with reference to FIG. 11.

Figure 11:
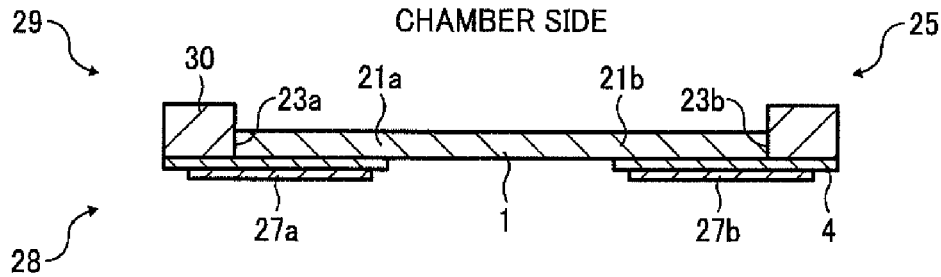
FIG. 11 is a vertical cross-sectional view of a piezoelectric actuator according to an illustrative embodiment.

FIG. 11 is a vertical cross-sectional view of a piezoelectric actuator according to the present illustrative embodiment. In the above-described illustrative embodiment, the first piezoelectric element 2*a* and the second piezoelectric element 2*b* are disposed on the diaphragm 1. In the present illustrative embodiment, as illustrated in FIG. 11, a first heating resistor 27*a* and a second heating resistor 27*b* are disposed on the diaphragm 1 instead of the first piezoelectric element 2*a* and the second piezoelectric element 2*b*. When the first heating resistor 27*a* and the second heating resistor 27*b* are supplied with voltages, areas of the diaphragm 1 corresponding to the first heating resistor 27*a* and the second heating resistor 27*b* expand due to an increase in temperature, thereby resulting in a displacement of the diaphragm 1 in the out-of-plane direction.

In FIG. 11, the diaphragm 1 is made of material having a low thermal conductivity. A high thermal conductive member 4 is formed between the diaphragm 1 and each of the first heating resistor 27*a* and the second heating resistor 27*b*.

Such a configuration can prevent the temperature in a middle portion of a first face 28 of the diaphragm 1 to be increased by thermal conduction, preventing the middle portion of the first face 28 of the diaphragm 1 from expanding due to heat accumulated when voltages are continuously supplied to the first heating resistor 27*a* and the second heating resistor 27*b*. As a result, the operation stability of the piezoelectric actuator 25 can be improved.

Figure 12A:
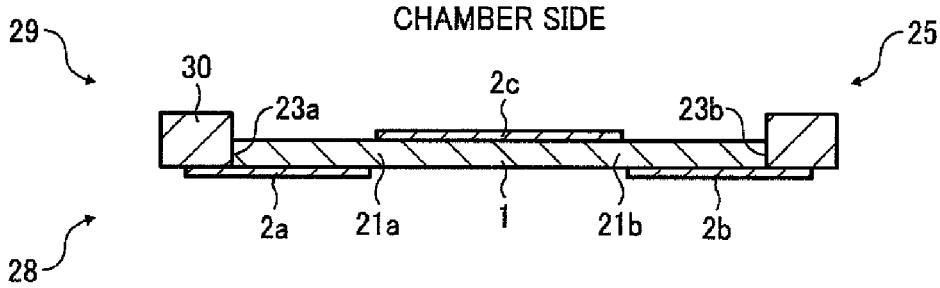
FIG. 12A is a vertical cross-sectional view illustrating a pre-displacement state of a piezoelectric actuator according to an illustrative embodiment.
Figure 12B:
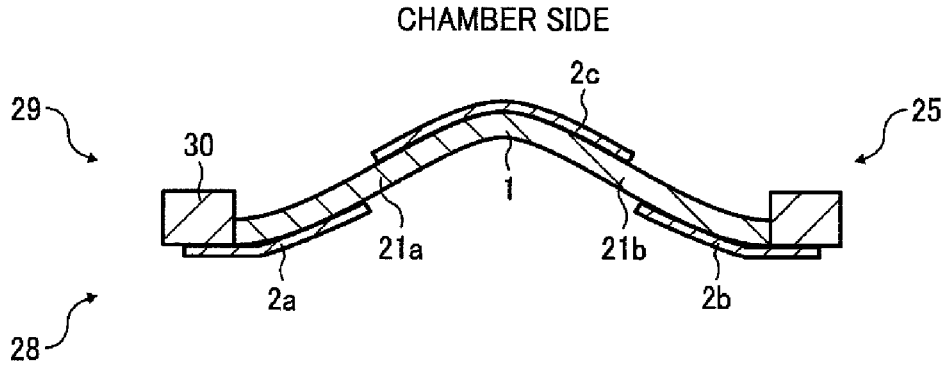
FIG. 12B is a vertical cross-sectional view illustrating a post-displacement state of the piezoelectric actuator illustrated in FIG. 12A.
Figure 13:
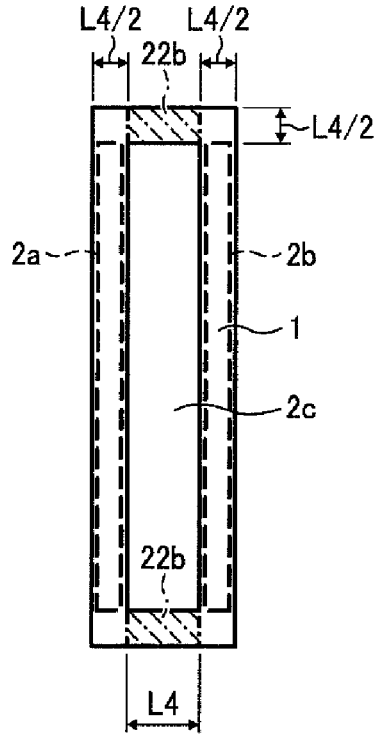
FIG. 13 is a plan view of the piezoelectric actuator seen from a liquid-chamber side.
Figure 14:
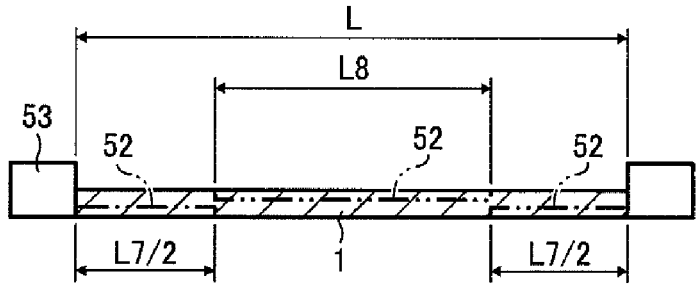
FIG. 14 is a vertical cross-sectional view illustrating a diaphragm assumed that piezoelectric elements are disposed on a middle portion and peripheral portions in the short direction of the diaphragm.

Next, another illustrative embodiment is described with reference to FIGS. 12A to 14. FIG. 12A is a vertical cross-sectional view illustrating a pre-displacement state of a piezoelectric actuator 25 according to the present illustrative embodiment. FIG. 12B is a vertical cross-sectional view illustrating a post-displacement state of the piezoelectric actuator according to the present illustrative embodiment. FIG. 13 is a plan view of the piezoelectric actuator 25 according to the present illustrative embodiment seen from the liquid-chamber side. FIG. 14 is a vertical cross-sectional view illustrating a diaphragm assumed that a plurality of piezoelectric elements are disposed on a middle portion and peripheral portions in the short direction.

In the present illustrative embodiment, as illustrated in FIGS. 12A and 12B, in addition to a first piezoelectric element 2*a* and a second piezoelectric element 2*b* described in the above-described illustrative embodiment illustrated in FIGS. 3 to 10B, a piezoelectric element 2*c* is disposed on an area from a first inflection point 21*a* to a second inflection point 21*b* on a second face 29 of the diaphragm 1 with respect to a cross section bent and displaced in the short direction of the diaphragm 1. In other words, the piezoelectric elements are disposed at areas A1 and A5, in each of which the curvature radius of the diaphragm 1 is local minimum, on the first face 28 and at an area A3, in which the curvature radius of the diaphragm 1 is local minimum, on the second face 29. A piezoelectric-material layer is not formed at areas at which piezoelectric elements are not disposed.

As illustrated in FIG. 13, the piezoelectric element 2*c* is also disposed across an area except end portions 22*b*, which are indicated by diagonal dashed lines, in a long direction of the diaphragm 1. Each of the end portions 22*b* is disposed on a middle portion in the short direction of the diaphragm 1 and is a rectangular area having a width of L4 in the short direction of the diaphragm 1 and a length of L4/2 in the long direction of the diaphragm 1.

Here, with reference to Table 1, a description is given to comparison results of the displacement amounts of the diaphragm 1 obtained by a simulation performed on assumption that piezoelectric elements are disposed at different areas of the diaphragm 1. As illustrated in FIG. 14, a model type assumed that the piezoelectric elements according to the present illustrative embodiment are disposed in a middle portion and peripheral portions in the short direction of the diaphragm 1 is referred to as Embodiment example 4. With respect to the above-described Embodiment examples 1 to 3 and Embodiment example 4, a diaphragm 51, an extensible area(s) 52 having a force extending in the in-plane direction, and hold areas 53 are described. In both the model types, the following conditions are assumed: L is 60 μm, the thickness "ta" of the diaphragm 1 is 3 μm, the thickness "tb" of the extensible area 52 is 0.5 μm, and the extensible force of the extensible area 52 in the in-plane direction is uniform. Further, Young's modulus=210 GPa and Poisson's ratio=0.27 are assumed in the entire area of the diaphragm 51 including the extensible area 52 of Embodiment examples 1 to 4. When L7=L8=30 μm is satisfied, the displacement amount of the middle portion of the diaphragm 51 in Embodiment example 4 (L8=30) is about twice that of Embodiment example 2 (L7=30).

A description is given of operation of a liquid-drop ejecting head 94. When voltages are supplied to the piezoelectric elements 2*a*, 2*b*, and 2*c* so that the piezoelectric elements 2*a*, 2*b*, and 2*c* extend in the short direction of the diaphragm 1, as illustrated in FIG. 12B, the diaphragm 1 is strongly bent and displaced toward the liquid chamber 64. Thus, the pressure of ink in the liquid chamber 64 is increased, ejecting ink drops from the nozzle orifices 65 to the sheet 83.

In the present illustrative embodiment, in addition to a first piezoelectric element 2*a* and a second piezoelectric element 2*b* described in the above-described illustrative embodiment illustrated in FIGS. 3 to 10B, a piezoelectric element 2C is disposed at an area from a first inflection point 21*a* to a second inflection point 21*b* (adjacent to the first inflection point 21*a*), securely obtaining a larger displacement amount of the diaphragm than the above-described illustrative embodiment illustrated in FIGS. 3 to 10B.

Each of the first piezoelectric element 2*a* and the second piezoelectric element 2*b* disposed on the first face 28 and the third piezoelectric element 2*c* disposed on the second face 29 are delimited by the inflection points 21*a* and 21*b* of the bend of the diaphragm 1. With such configuration, even when voltages of the same polarity are supplied to the first piezoelectric element 2*a*, the second piezoelectric element 2*b*, and the third piezoelectric element 2*c*, the displacement amount of the diaphragm 1 can be effectively increased without reducing the displacement of the diaphragm 1. Accordingly, only one opposing electrode is provided for one piezoelectric actuator 25, resulting in cost reduction.

It is to be noted that the present invention is not limited to the above-described illustrative embodiments and variations and modifications are possible within the scope of the present invention.

Figure 15A:
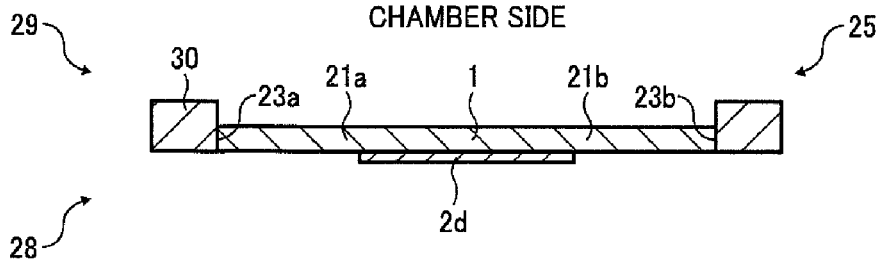
FIG. 15A is a vertical cross-sectional view illustrating a pre-displacement state of a piezoelectric actuator.
Figure 15B:
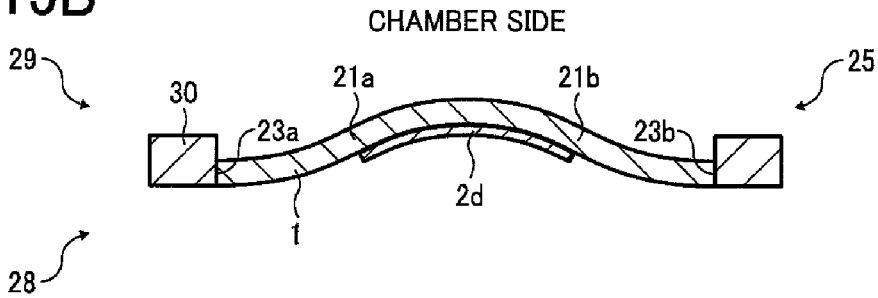
FIG. 15B is a vertical cross-sectional view illustrating a post-displacement state of the piezoelectric actuator illustrated in FIG. 15A.

In the above-described illustrative embodiment, the first piezoelectric element 2*a* and the second piezoelectric element 2*b* are disposed at an area from the first end 23*a* to the first inflection point 21*a* and an area from the second end 23*b* to the second inflection point 21*b*, respectively. However, it is to be noted that the positions of the first piezoelectric element 2*a* and the second piezoelectric element 2*b* are not limited to the above-described areas. For example, a piezoelectric element 2*d* may be disposed in an area between the first inflection point 21*a* and the second inflection point 21*b*. In such a case, as illustrated in FIGS. 15A and 15B, the piezoelectric element 2*d* may be disposed so as to include an area A3

(illustrated in FIG. 7) in which the curvature radius of the diaphragm 1 is local minimum. Alternatively, the piezoelectric element 2*d* may be disposed across an area between the first inflection point 21*a* and the second inflection point 21*b*.

Although in FIGS. 12A and 12B the third piezoelectric element 2*c* is disposed on the second face 29 of the diaphragm 1, the third piezoelectric element 2*c* may be disposed on the first face 28 of the diaphragm 1. In such a case, a voltage of a polarity differing from a polarity of the first piezoelectric element 2*a* and the second piezoelectric element 2*b* is supplied to the third piezoelectric element 2*c*.

In the above-described illustrative embodiments illustrated in FIGS. 3 to 10B and 11, in a cross section displaced in the short direction of the diaphragm 1, piezoelectric elements or heating resistors are disposed over an area between the first end 23*a* and the fist inflection point 21*a* and an area between the second end 23*b* and the second inflection point 21*b*. However, the positions of piezoelectric elements or heating resistors are not limited to the above-described areas and may be disposed only at, for example, the areas A1 and A5 illustrated in FIG. 7 in which the curvature radius of the diaphragm 1 is local minimum.

In the above-described illustrated embodiment illustrated in FIGS. 12A to 14, in the cross section displaced in the short direction of the diaphragm 1, one piezoelectric element is disposed at an area between the first inflection point 21*a* and the second inflection point 21*b*. The position of the piezoelectric element is not limited to the above-described area, and the piezoelectric element may be disposed at, for example, only the area A3 illustrated in FIG. 7 in which the curvature radius of the diaphragm 1 is local minimum.

In the above-described illustrative embodiments, the piezoelectric actuator 25 is used for a liquid-drop ejecting head. However, it is to be noted that the piezoelectric actuator 25 may be used for an optical device, such as a data projector used for electronic presentation, in which a diaphragm and a mirror are integrally molded.

Alternatively, by arranging a plurality of piezoelectric actuators 25 so that a diaphragm 1 constitute part of wall-faces of fluid channels, the plurality of piezoelectric actuators 25 may be used for a micro pump for a medical device, a semiconductor manufacturing device, or the like.

Figure 16:
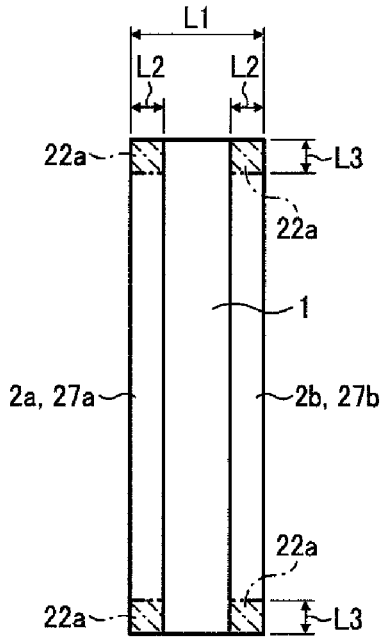
FIG. 16 is a plan view illustrating a piezoelectric actuator according to a variation example seen from a side opposite a liquid-chamber side.

As illustrated in FIG. 16, piezoelectric elements or heating resistors may be further provided at long-directional end portions 22*a*, which are indicated by diagonal dashed lines, on the first face 28 of the diaphragm 1. Such a configuration can increase the displacement of the long-directional end portions 22*a*, thereby providing a larger displacement amount of the diaphragm 1 than the above-described illustrative embodiment. In such a case, with respect to the area in which piezoelectric elements or heating resistors are disposed on the diaphragm 1, where the length in the short direction of the diaphragm 1 is L1, each of L2 and L3 is set to L1/4.

In the above-described illustrative embodiments of FIGS. 3 to 10B and FIGS. 12A to 14, piezoelectric elements are provided on the diaphragm 1 as active elements. Alternatively, instead of piezoelectric elements, heating resistors may be provided on the diaphragm 1 as the active elements.

In the above-described illustrative embodiment illustrated in FIG. 11, the first heating resistor 27*a* and the second heating resistor 27*b* are disposed via high-thermal conductive members 4 on the first face 28 of the diaphragm 1. Alternatively, in addition to the heating resistors 27*a* and 27*b*, another heating resistor may be provided on the second face 29 of the area between the first inflection point 27*a* and the second inflection point 21*b* via a high thermal conductive member.

Figure 17:
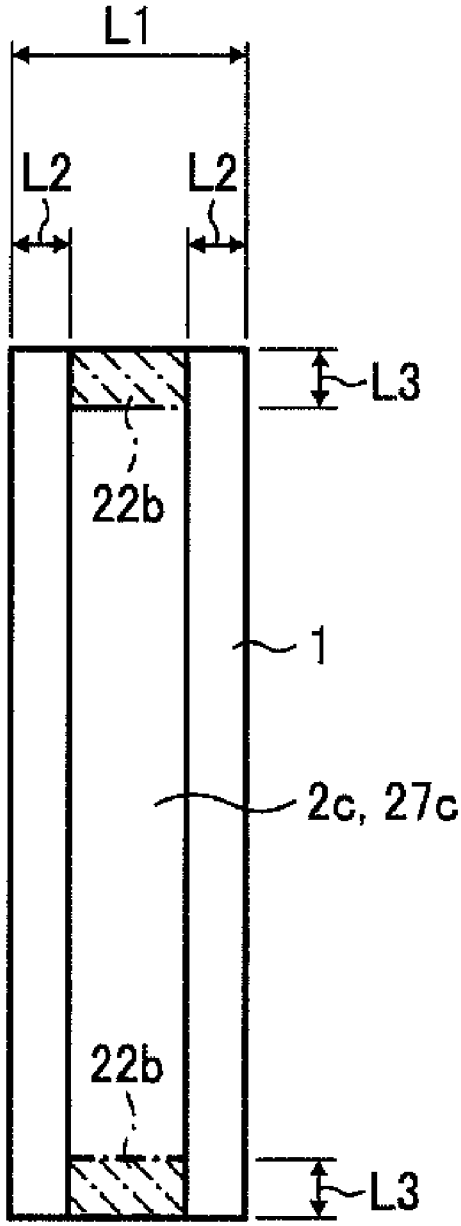
FIG. 17 is a plan view illustrating the piezoelectric actuator illustrated in FIG. 16 seen from a liquid-chamber side.

As illustrated in FIG. 17, a piezoelectric element 2*c* or a heating resistor 27*c* may be further provided to include long-directional end portions 22*b*, which are indicated by diagonal dashed lines, on the second face 29 of the diaphragm 1. Such a configuration can provide a larger displacement amount of the diaphragm 1 than the above-described illustrative embodiment of FIG. 11. In such a case, with respect to the areas in which the piezoelectric element 2*c* or the heating resistor 27*c* are disposed on the diaphragm 1, each of L2 and L3 is set to L1/4 where the length in the short direction of the diaphragm 1 is L1.

In the above-described illustrative embodiments, the liquid-drop ejecting head 94 uses the side shooter method in which the orientation of ink channel differs from the orientation of nozzle orifice (ejection port) 8. Alternatively, the liquid-drop ejecting head 94 may use the edge shooter method in which a portion from an ink channel to the a nozzle orifice (ejection port) 8 has a linear shape.

In the above-described illustrative embodiments, the liquid-drop ejecting head according to the present disclosure is described as an ink ejection head for ejecting ink as drops. In one example, the liquid-drop ejecting head may be a liquid drop ejecting head for ejecting liquid resist as drops to produce semiconductor substrates. In another example, the liquid-drop ejecting head may be a liquid-drop ejecting head for ejecting liquid crystal as drops to produce a liquid crystal panel. In still another example, the liquid-drop ejecting head may be a liquid-drop ejecting head (spotter) for ejecting DNA (deoxyribonucleic acid) samples as drops to produce DNA chips.

In the above-described illustrative embodiments, the image forming apparatus 81 is described as a printer. However, it is to be noted that the image forming apparatus is not limited to such a printer and may be, for example, a copier including an image reading unit, a multi-functional peripheral including such a copier and a post-processing device.

Next, a liquid-drop ejecting head according to another illustrative embodiment is described. Below, an upper electrode is divided into three portions (right, middle, and left portions) and formed on a piezoelectric element that is formed on one face of a diaphragm of a piezoelectric actuator constituting part of a liquid-drop ejecting head. The middle portion of the upper electrode is an individual electrode, and the right and left portions of the upper electrode are common electrodes that are shared among all piezoelectric actuators constituting the liquid-drop ejecting head. The common electrode is supplied with a common potential, and the individual electrode is supplied with an individual potential having the same amount as the common potential, which is controlled independent of the common electrode.

Prior to describing the liquid-drop ejecting head according to the present illustrative embodiment, a description is given of the division of an upper electrode when the upper electrode is formed.

Figure 18A:
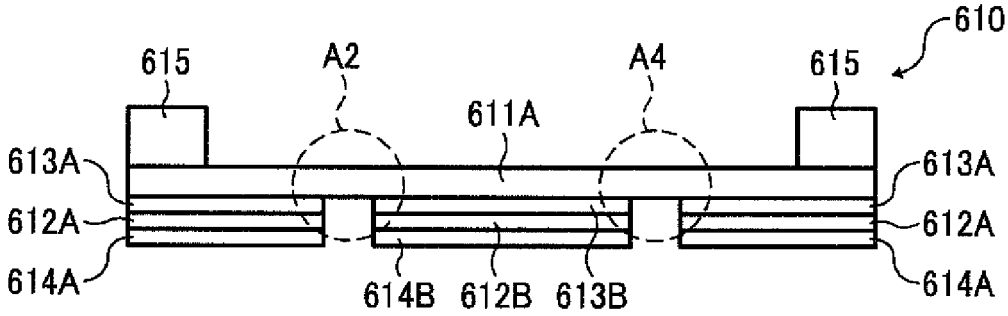
FIGS. 18A and 18B are schematic views for explaining division of an upper electrode in a piezoelectric actuator according to an illustrative embodiment of the present disclosure.
Figure 18B:
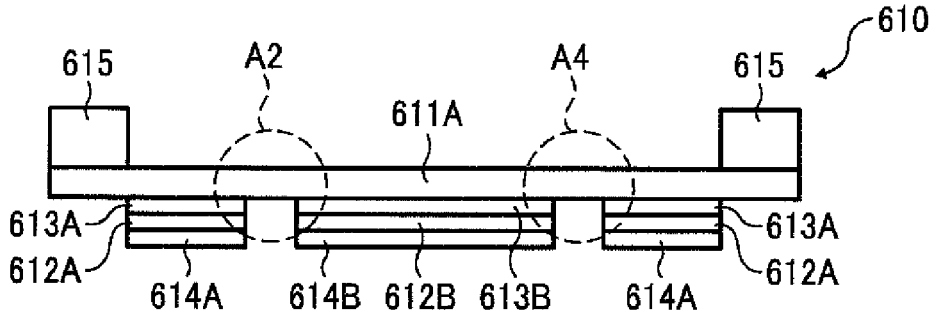

FIG. 18A is a schematic view illustrating an example of positions at which upper electrodes 14A is formed. FIG. 18B is a schematic view illustrating another example of positions at which upper electrodes 14A are formed.

Figure 1B:
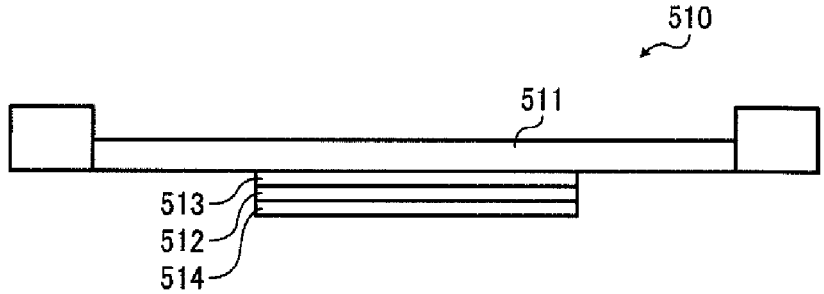
Figure 1C:
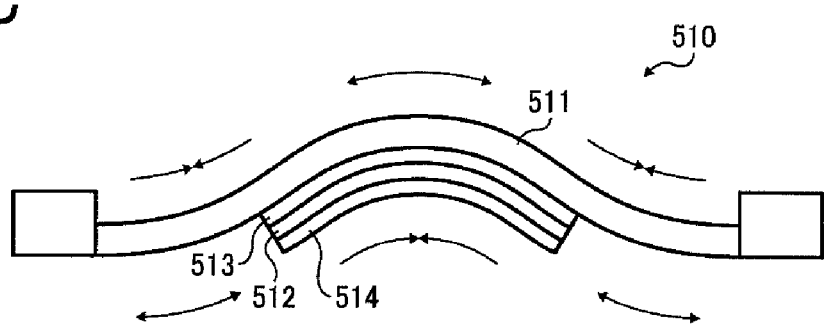

As illustrated in FIG. 18A, piezoelectric elements 612A and 612B, lower electrodes 613A and 613B, and the upper electrodes 614A and 614B are provided on the diaphragm 611A so that the extension and contraction directions of each of the piezoelectric elements 612A are opposite the extension and contraction directions of the piezoelectric element 612B on both sides of each of the areas A2 and A4 including inflection points. Accordingly, a relatively large displacement amount of the diaphragm 611A can be obtained compared to when a piezoelectric element is not divided as illustrated in FIGS. 1A to 1C. Alternatively, as illustrated in FIG. 18B, the piezoelectric elements 612A, the lower electrodes 613A, and the upper electrodes 614A may be formed so as not to overlap the separation walls 615.

Figure 19:
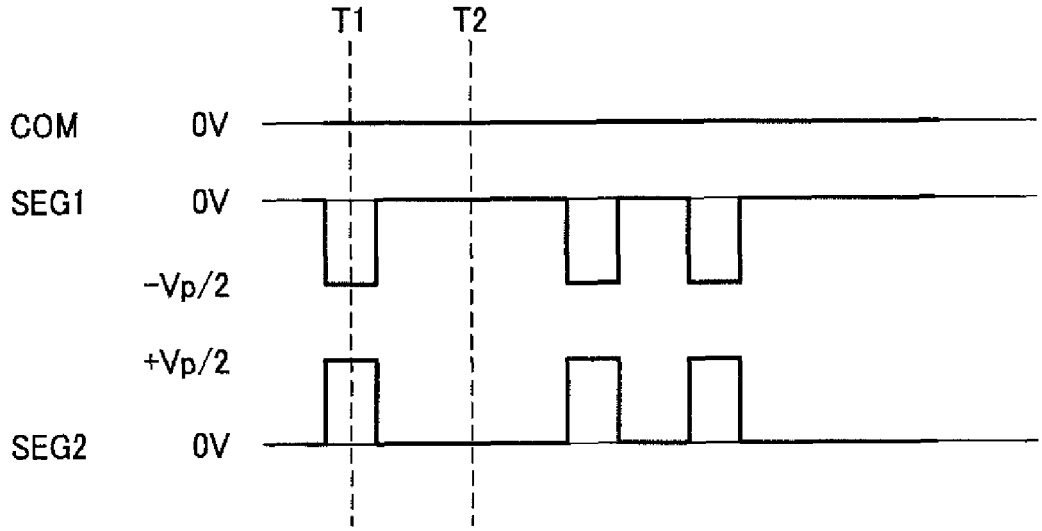
FIG. 19 is a diagram for explaining a driving method of the piezoelectric actuator illustrated in FIGS. 18A and 18B.

FIG. 19 is a diagram for explaining a driving method of the piezoelectric actuator 610 illustrated in FIGS. 18A and 18B.

The lower electrodes 613A and 613B formed on the diaphragm 611A are common electrodes (hereinafter "COM") supplied with a common voltage of, for example, 0V as illustrated in FIG. 19. The upper electrodes 614A are supplied with a driving voltage SEG1 for the piezoelectric elements 612A, and the upper electrode 614B is supplied with a driving voltage SEG2 for the piezoelectric element 612B.

In the piezoelectric actuator 610, giving opposite polarities to the driving voltage SEG1 and the driving voltage SEG2 can displace the diaphragm 611A. For example, when the piezoelectric elements 612A and the piezoelectric element 612B are supplied with the driving voltages SEG1 and SEG2 at a timing T1 of FIG. 19, the driving voltage SEG1 and the driving voltage SEG2 are set to opposite polarities. In FIG. 19, the potential levels of the driving voltages SEG1 and SEG2 are identical.

Figure 2:
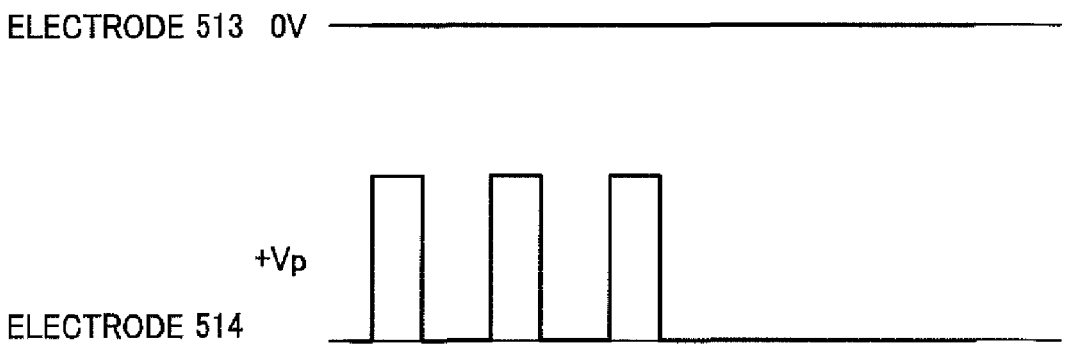
FIG. 2 is a diagram illustrating voltages supplied to electrodes.

Thus, when the diaphragm 611A is displaced, a voltage half of a driving voltage Vp illustrated in FIG. 2 can provide a displacement amount substantially equal to the displacement amount of the diaphragm 11 in the conventional technology illustrated in FIGS. 1A to 1C. Such an arrangement can prevent premature degradation of the piezoelectric element, thus providing a longer service life thereof.

Alternatively, to prevent the displacement of the diaphragm 611A, the driving voltage SEG1 and the driving voltage SEG2 are set to 0V as illustrated in a timing T2 of FIG. 19. If either of the piezoelectric element 612A and the piezoelectric element 612B is supplied with a voltage, the diaphragm 611A might be displaced at a displacement amount about half of the displacement amount δ1, which is not conducive to many uses.

It is to be noted that, in the configurations illustrated in FIGS. 18A and 18B, the upper electrodes 614A and 614B are supplied with the driving voltages SEG1 and SEG2 of opposite polarities, requiring separate drivers for the upper electrodes 614A and 614B. By contrast, in the following illustrative embodiment, even when an upper electrode divided into a plurality of portions is formed on a diaphragm, a displacement amount substantially equal to the displacement amount δ1 can be obtained at relatively low driving voltage without requiring separate driving drivers. Such a configuration can reduce product cost and size and provide high-speed driving and longer product life.

Figure 20:
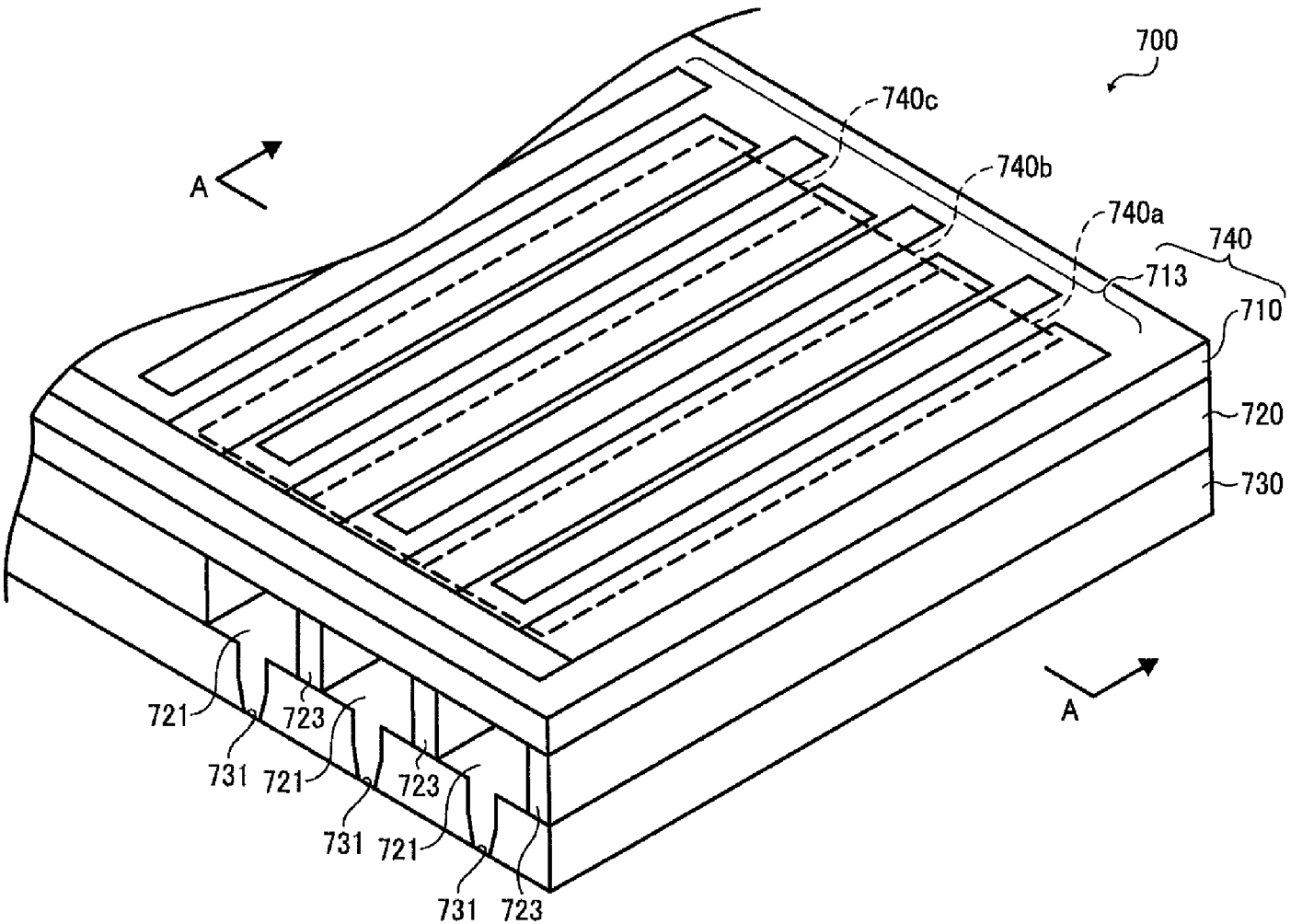
FIG. 20 is a schematic view illustrating a liquid-drop ejecting head.

A description is given of such an illustrative embodiment with reference to FIG. 20, which is a schematic view illustrating a liquid-drop ejecting head 700 according to the present illustrative embodiment.

The liquid-drop ejecting head 700 is used in, for example, an inkjet printer or some other type of printing machine. The liquid-drop ejecting head 700 includes a diaphragm 710 supported by separation walls 723, a ceramic layer 720 in which ink chambers are formed, and a stainless-steel layer 730 in which nozzle orifices 731 to eject ink drops are formed.

In the diaphragm 710, a lower electrode 711, a piezoelectric element 712, and an upper electrode 713 are deposited, in that order, on a face of the diaphragm 710 opposite a face on which the ceramic layer 720 is formed to form a piezoelectric actuator 740.

The piezoelectric actuator 740 is provided for each ink chamber 721 to form the liquid-drop ejecting head 700.

Figure 21:
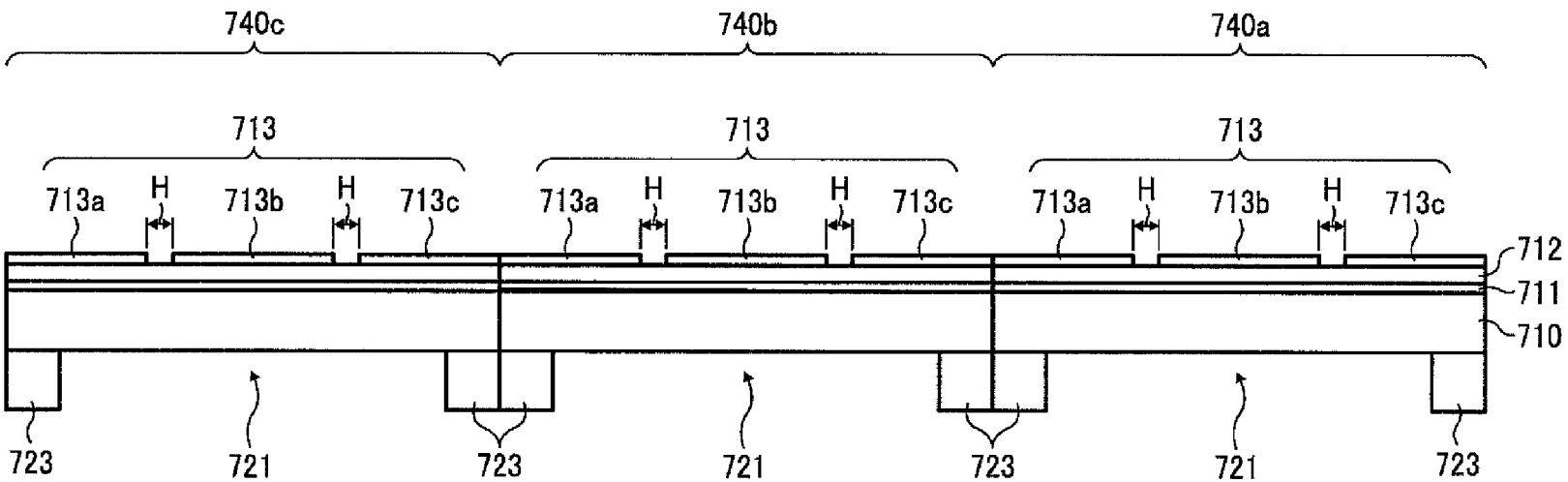
FIG. 21 is a cross-sectional view of the liquid-drop ejecting head cut along a line A-A illustrated in FIG. 20.

FIG. 21 is a cross-sectional view illustrating the liquid-drop ejecting head 700 cut along a line A-A illustrated in FIG. 20. Since a first piezoelectric actuator 740*a*, a second piezoelectric actuator 740*b*, and a third piezoelectric actuator 740*c* illustrated in FIG. 21 have the same configuration, a description is given below of the piezoelectric actuator 740*a* as a representative example.

In the piezoelectric actuator 740*a*, a lower electrode 711 is formed on a face of the diaphragm 710 opposite a face on which the liquid chamber 721 is formed. A piezoelectric element 712 is formed on a face of the lower electrode 711 opposite a face on which the lower electrode 711 contacts the diaphragm 710. In the present illustrative embodiment, the diaphragm 710 is shared among the piezoelectric actuators 740*a*, 740*b*, and 740*c*. Likewise, the lower electrode 711 and the piezoelectric element 712 are shared among the piezoelectric actuators 740*a*, 740*b*, and 740*c*. Accordingly, the lower electrode 711 and the piezoelectric element 712 may be formed on the diaphragm 710 so that each of the lower electrode 711 and the piezoelectric element 712 has the same area as the diaphragm 710.

In the piezoelectric actuator 740*a*, the upper electrode 713 is formed on a face of the piezoelectric element 712 opposite a face on which the piezoelectric element 712 contacts the lower electrode 711. The upper electrode 713 is divided into three portions: a first upper electrode 713*a*, a second upper electrode 713*b*, and a third upper electrode 713*c*. As described with reference to FIGS. 18A and 18B, the first upper electrode 713*a*, the second upper electrode 713*b*, and the third upper electrode 713*c* are formed so as to bracket areas H including inflection points. In FIG. 21, the areas H are relatively narrow, and the first upper electrode 713*a*, the second upper electrode 713*b*, and the third upper electrode 713*c* are formed to overlap the separation walls 723.

In the present illustrative embodiment, the lower electrode 711 is a first common electrode C1. The first common electrode C1 is shared among the piezoelectric actuators 740*a*, 740*b*, and 740*c*. The first common potential COM1 is supplied to the first common electrode C1 connected to the ground.

In the tripartite upper electrode 713, the second upper electrode 713*b* located between the first and third upper electrodes 713*a* and 713*c* is an individual electrode S, which is electrically independent of the other two electrodes 713*a* and 713*c* in each of the piezoelectric actuators 740*a*, 740*b*, and 740*c*. The upper electrode 713*b* is supplied with an individual potential SEG that is a control potential to control the piezoelectric element 712.

In the tripartite upper electrode 713, the first upper electrode 713*a* and the third upper electrode 713*c*, which are located on both sides of the second upper electrode 713*b* to bracket the areas H, are second common electrodes C2. The second common electrodes C2 are shared among the piezoelectric actuators 740*a*, 740*b*, and 740*c* and supplied with a second common potential COM2.

As described above, in the tripartite upper electrode 713, the first upper electrode 713*a* and the third upper electrode 713*c* are used as the common electrode C2 in a plurality of piezoelectric actuators constituting the piezoelectric actuator 740. Such a configuration allows the plurality of piezoelectric actuators to be driven by only a driver for the individual electrode S.

Figure 22:
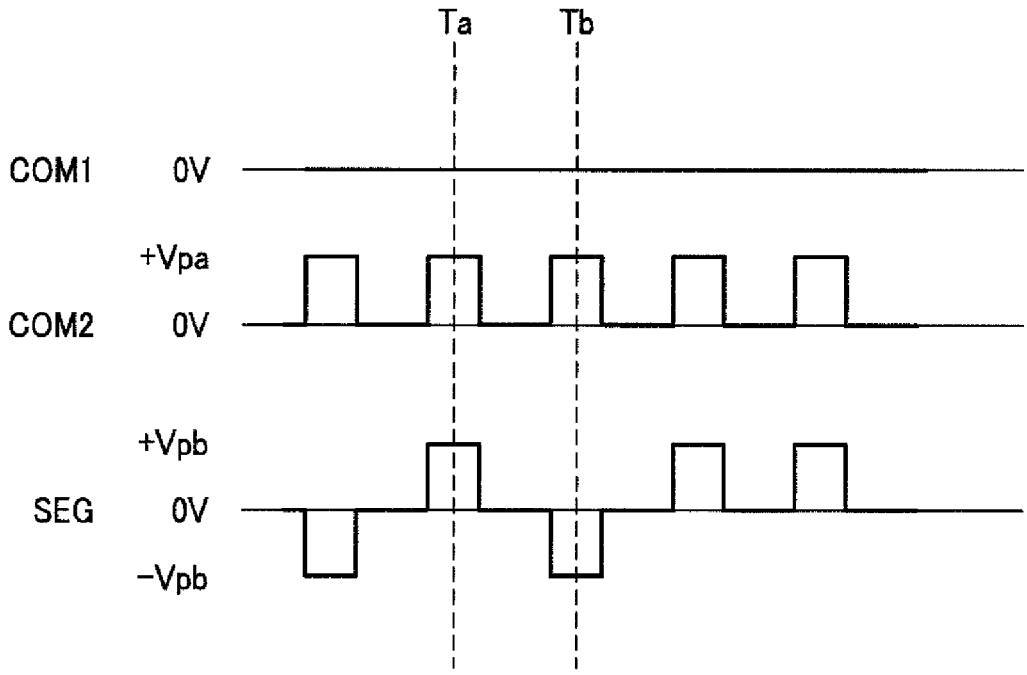
FIG. 22 is a diagram for explaining a driving method of a piezoelectric actuator according to an illustrative embodiment.

Next, a description is given of a driving method of the piezoelectric actuator 740 with reference to FIG. 22. FIG. 22 is a diagram for explaining the driving method of the piezoelectric actuator 740.

In the present illustrative embodiment, the common electrode C1 is connected to the ground, and therefore the common potential COM1 supplied to the common electrode C1 is 0V.

The common electrode C2 is supplied with the common voltage COM2, which is supplied at a certain interval as a pulse signal. In the present illustrative embodiment, the individual voltage SEG is supplied to the individual electrode S in sync with the common voltage COM2 to displace the diaphragm 710.

For example, to displace the diaphragm 710, the individual voltage SEG is set to a polarity opposite a polarity of the common voltage COM2. By contrast, to prevent displacement of the diaphragm 710, the individual voltage SEG is set to the same polarity as the polarity of the common voltage COM2.

For example, at a timing Ta illustrated in FIG. 22, the common voltage COM2 supplied to the common electrode C2 has a voltage value "Vpa". Further, at the timing Ta, the individual voltage SEG supplied to the individual electrode S has a voltage value "Vpb" of the same polarity as the polarity of "Vpa". Accordingly, the diaphragm 710 is not displaced at the timing Ta.

By contrast, at a timing Tb, the individual voltage SEG supplied to the individual electrode S has a voltage value −Vpb of a polarity opposite the polarity of the voltage value Vpa. Accordingly, the diaphragm 710 is displaced at the timing Tb.

In the present illustrative embodiment, the voltage value Vpa of the common voltage COM2 is substantially the same as the voltage value Vpb of the individual voltage SEG.

As described above, in the piezoelectric actuator 740*a*, a voltage signal shared with the other piezoelectric actuators 740*b* and 740*c* constituting the piezoelectric actuator 740 is supplied to the common electrodes COM1 and COM2. The individual voltage SEG to control the driving of the piezoelectric actuator 740*a* is supplied to the individual electrode S. In other words, in the present illustrative embodiment, the driving of the piezoelectric actuator 740*a* is controlled only by the individual voltage SEG.

As described above, each of the piezoelectric actuators 740*b* and 740*c* has the same configuration as the above-described configuration of the piezoelectric actuators 740*a*. Moreover, although in the present illustrative embodiment the piezoelectric actuator 740 includes the three piezoelectric actuators 740*a*, 740*b*, and 740*c*, the configuration of the piezoelectric actuator 740 is not limited to the above-described configuration and may include any suitable number of piezoelectric actuators.

As described above, in the liquid-drop ejecting head 700 including the plurality of piezoelectric actuators 740, the first upper electrode 713*a* and the third upper electrode 713*c* adjacent to other piezoelectric actuators are used as the common electrodes C2 out of the upper electrodes 713*a*, 713*b*, and 713*c* of each piezoelectric actuator 740.

Accordingly, to drive the liquid-drop ejecting head 700 may require one common driver for supplying the common voltage COM2 to the common electrode C2 and the same number of drivers as the piezoelectric actuators for supplying the individual voltage SEG to the individual electrode S of each of the piezoelectric actuators constituting the liquid-drop ejecting head 700. Accordingly, independent drivers corresponding to the tripartite upper electrodes are not required, reducing the number of drivers and the product cost.

Further, in the present illustrative embodiment, the driving of the piezoelectric actuator 740*a* is controlled while synchronizing the individual voltage SEG supplied to the individual electrode S with the common voltage COM2 supplied to the common electrode C2. Such a configuration does not require separately controlling the common voltage COM2 and the individual electrode SEG, allowing high-speed driving.

In the present illustrative embodiment, the driving of the piezoelectric element 712 is controlled by the individual voltage SEG of the polarity opposite the polarity of the common voltage COM2. Such a configuration allows the diaphragm 710 to greatly displace at a relatively low driving voltage value of the piezoelectric element 712, preventing degradation of the piezoelectric element 712 and allowing a longer service life of the piezoelectric element 712.

Next, the results of driving simulation of the piezoelectric actuator 740 is described with reference to FIGS. 23A to 23C.

FIGS. 23A to 23C illustrate a driving simulation of the piezoelectric actuator 740 using a piezoelectric actuator 750 designed for simulation. FIG. 23A is a schematic view illustrating the piezoelectric actuator 750. FIG. 23B is a diagram illustrating driving voltages during simulation. FIG. 23C is a table showing results of simulation.

The piezoelectric actuator 750 includes a tripartite lower electrode structure, that is, a first lower electrode 751*a*, a second lower electrode 751*b*, and a third lower electrode 751*c*, on a diaphragm 710 supported on separation walls 723A. A first piezoelectric element 752*a*, a second piezoelectric element 752*b*, and a third piezoelectric element 752*c* are formed on the first lower electrode 751*a*, the second lower electrode 751*b*, and the third lower electrode 751*c*, respectively. A first upper electrode 753*a*, a second upper electrode 753*b*, and a third upper electrode 753*c* are formed on the first piezoelectric element 752*a*, the second piezoelectric element 752*b*, and the third piezoelectric element 752*c*, respectively. The first lower electrode 751*a*, the first piezoelectric element 752*a*, the first upper electrode 753*a*, the third lower electrode 751*c*, the third piezoelectric element 752*c*, and the third upper electrode 753*c* are formed so as not to overlap the separation walls 723A.

In the piezoelectric actuator 750, the first and third upper electrodes 753*a* and 753*c* contract the diaphragm 710A via the first and third piezoelectric elements 752*a* and 752*c*, and the second upper electrode 753*b* extends the diaphragm 710A via the second piezoelectric element 752*b*.

As material constants, each of the diaphragm 710A and the first to third piezoelectric elements 752*a*, 752*b*, and 752*c* has a Young's modulus of 210 GPa, a Poisson's ratio of 0.29, and a thickness of 0.5 μm. Further, the following conditions are assumed: the short-direction length of the diaphragm 710A is 60 μm, the width LD1 of each of the piezoelectric elements 752*a* and 752*c* is 15 μm, the width Ld2 of the piezoelectric element 752*b* is 30 μm, and there are no gaps between the piezoelectric elements 752*a*, 752*b*, and 752*c*. With respect to the extension and contraction amounts of the piezoelectric elements 752*a*, 752*b*, and 752*c*, the lengths extending in the short direction of the diaphragm are represented by FL1 and FL2, which are ratios to the original widths Ld1 and Ld2, respectively. As illustrated in FIG. 23B, this model assumes that a common voltage COM4 is supplied to the lower electrodes 751*a*, 751*b*, and 751*c* and a driving voltage SEG3 is supplied to the upper electrode 752*b*. The voltage value Vp3 of the common voltage COM4 is set substantially the same as the voltage value Vp4 of the driving voltage SEG3.

Results of simulation under the above-described conditions are shown in FIG. 23C.

Case 0 shows computation results for reference and assumes that a driving waveform at a timing Tc illustrated in FIG. 23B is supplied. Case 1 shows computation results on assumption that a driving waveform at a timing Td illustrated in FIG. 23B is supplied. Case 2 shows computation results on assumption that a driving waveform at a timing Te illustrated in FIG. 23B is supplied.

The displacement amount of case 1 is about twice the displacement amount of case 0, and the displacement amount of case 2 is about one-ninth the displacement amount of case 0. The displacement amount of case 1 is about eighteen times the displacement amount of case 2. In other words, FIG. 23C shows that, when the extension and contraction directions of each of the piezoelectric elements 752*a* and 752*c* are opposite the extension and contraction directions of the piezoelectric element 752*b*, the displacement amount of the diaphragm 710A is increased. By contrast, when the extension and contraction directions of each of the piezoelectric elements 752*a* and 752*c* are the same as the extension and contraction directions of the piezoelectric element 752*b*, the displacement amount of the diaphragm 710A is greatly reduced.

Similar to the piezoelectric actuator 750, in the piezoelectric actuator 740 as well, the displacement amount of the diaphragm 710A at the timing Tb illustrated in FIG. 22 becomes about eighteen times the displacement amount at the timing Ta.

As with the piezoelectric actuator 740, when the difference between relatively large and small displacement amounts is as large as eighteen times, the change in the displacement amount can be used as ON/OFF switch. That is, the piezoelectric actuator 740 can be used as a switch for switching ON/OFF states.

Next, the production method of the piezoelectric actuator 740 is described with reference to FIGS. 24A to 24E.

FIGS. 24A to 24E are flow diagrams for explaining the production method of the piezoelectric actuator 740.

Figure 24A:
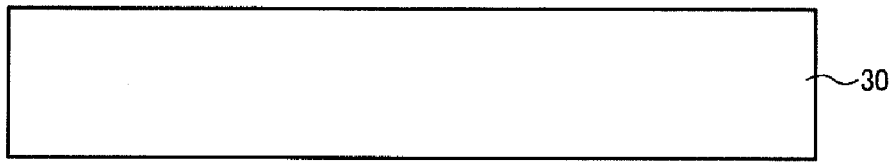
FIGS. 24A to 24E are flow diagrams for explaining the production method of a piezoelectric actuator according to an illustrative embodiment.
Figure 24B:
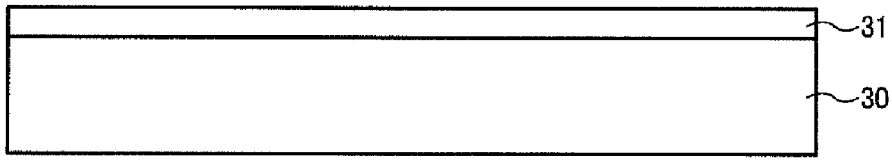
Figure 24C:
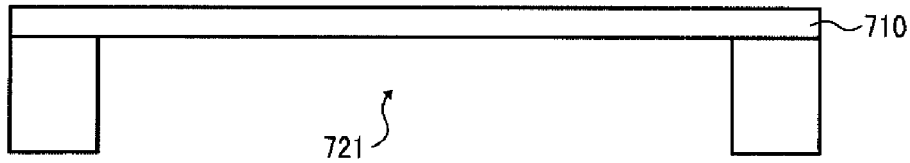
Figure 24D:
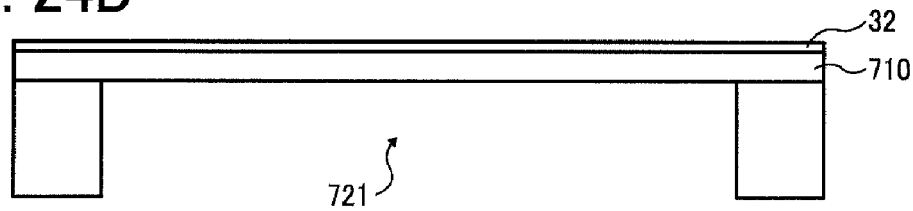
Figure 24E:
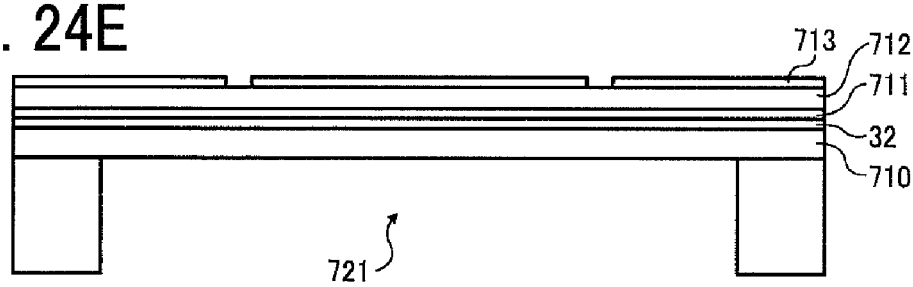

In FIG. 24A, high-concentration boron is applied to one face of a Si substrate 30 in a time-controlled manner to form a high-concentration boron layer 31 (illustrated in FIG. 24B). Next, a $SiO_2$ film is formed by chemical vapor deposition (CVD) on a face of the Si substrate 30 opposite the face on which the high-concentration boron layer is formed, and the SiO2 film of a portion to form a liquid chamber 721 of the piezoelectric actuator 740 is removed. Using KOH (potassium hydrate), Si of the portion to form the liquid chamber 721 is etched in the high-concentration boron layer to from a diaphragm 710 (FIG. 24C). Another $SiO_2$ film 32 is formed on an upper face of the high-concentration boron layer (FIG. 24D). Then, as illustrated in FIG. 24E, a lower electrode 711, a piezoelectric element 712, and an upper electrode 713 are deposited in turn to form a piezoelectric actuator 740. In FIG. 24E, the lower electrode 711 and the piezoelectric element 712 are plain films, and the upper electrode 713 is provided with a pattern to form an electrically independent piezoelectric element 712 on each piezoelectric actuator.

As described above, in the piezoelectric actuator 740, the piezoelectric element 712 is formed of a thin film, contributing to the downsizing of the liquid-drop ejecting head 700.

It is to be noted that although in the present illustrative embodiment, the piezoelectric actuator 740 includes the lower electrode 711 and the piezoelectric element 712 formed of plain films, the configuration of the piezoelectric actuator 740 is not limited to the above-described configuration.

Figure 25:
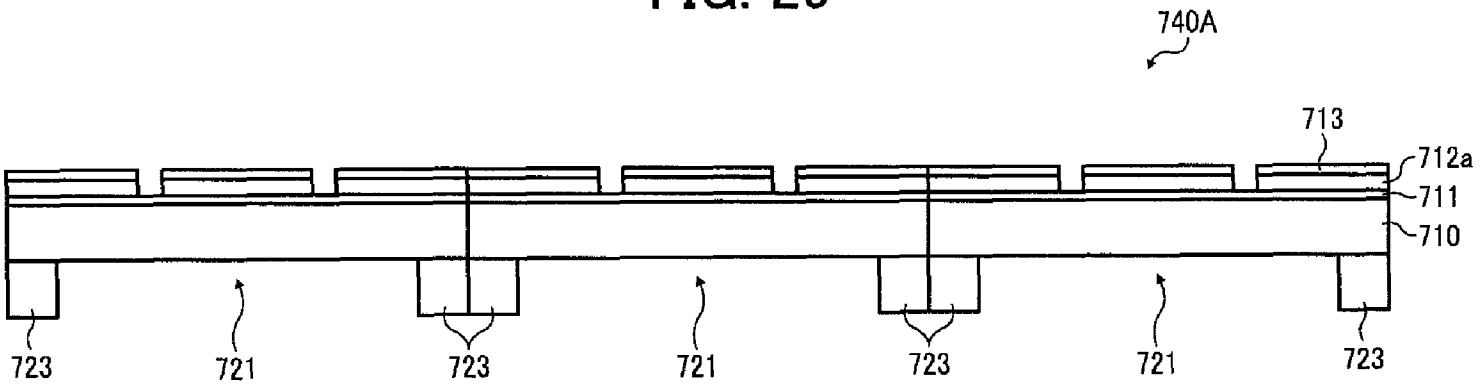
FIG. 25 is a schematic view illustrating a variation example of the piezoelectric actuator.
Figure 26:
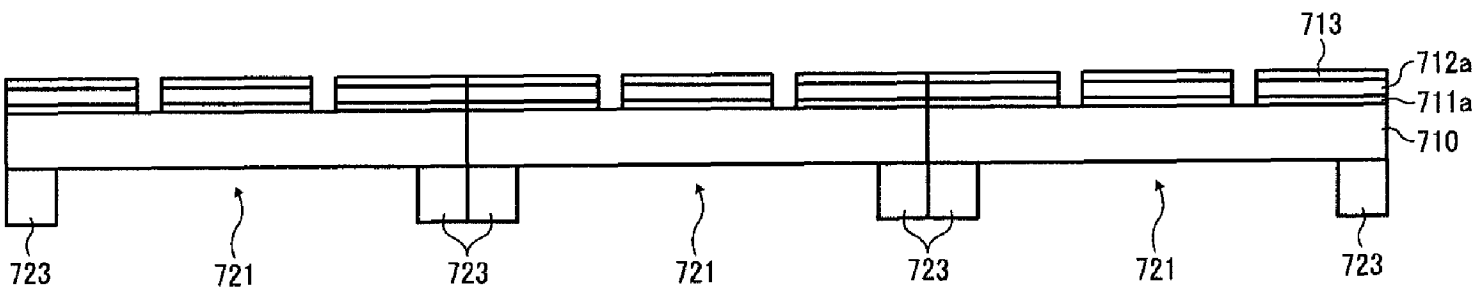
FIG. 26 is a schematic view illustrating another variation example of the piezoelectric actuator.
Figure 27:
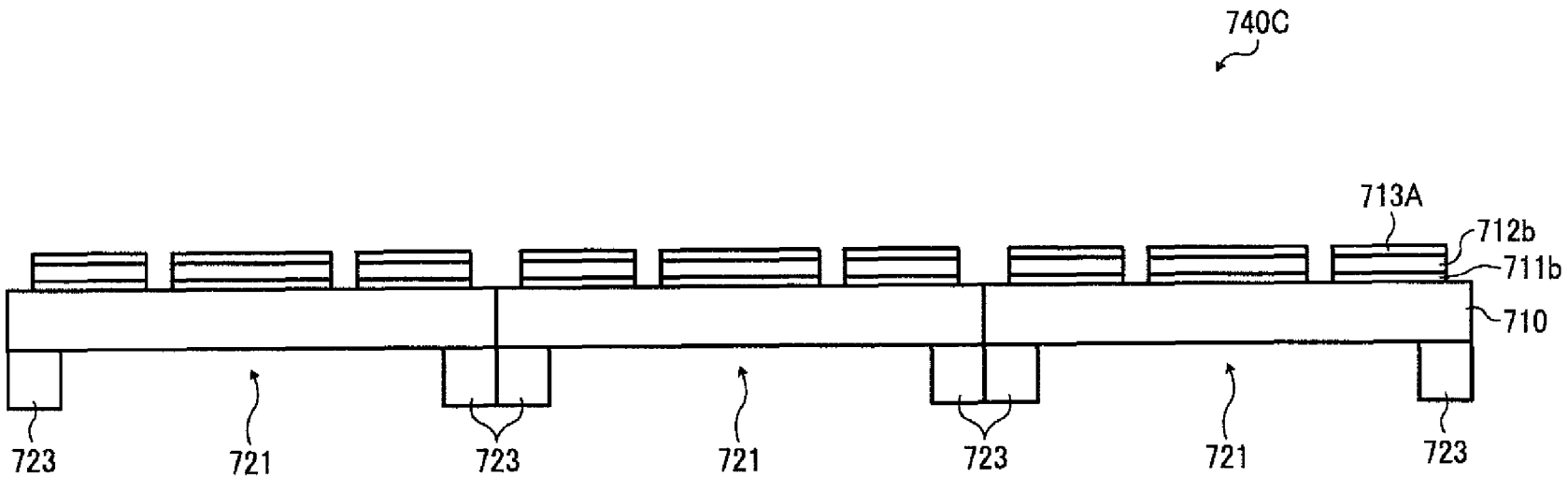
FIG. 27 is a schematic view illustrating still another variation example of the piezoelectric actuator.

FIGS. 25 to 27 show variations of the piezoelectric actuator 740.

FIG. 25 is a schematic view illustrating a first variation example of the piezoelectric actuator 740.

In a piezoelectric actuator 740A illustrated in FIG. 25, a lower electrode 711 alone may be formed of a plain film, and a piezoelectric element 712*a* may be divided into three portions similar to the upper electrode 713.

FIG. 26 is a second variation example of the piezoelectric actuator 740.

In a piezoelectric actuator 740B illustrated in FIG. 26, all of a lower electrode 711*a*, a piezoelectric element 712*a*, and an upper electrode 713 may be divided into three portions.

FIG. 27 is a third variation example of the piezoelectric actuator 740.

In a piezoelectric actuator 740C illustrated in FIG. 27, all of a lower electrode 711*b*, a piezoelectric element 712*b*, and an upper electrode 713A may be divided into three portions. Further, each of the lower electrode 711*b*, the piezoelectric element 712*b*, and the upper electrode 713A may be formed to have a portion not overlapping a separation wall 123.

Next, operation of a liquid-drop ejecting apparatus 800 employing the liquid-drop ejecting head 700 is described with reference to FIG. 28.

Figure 28:
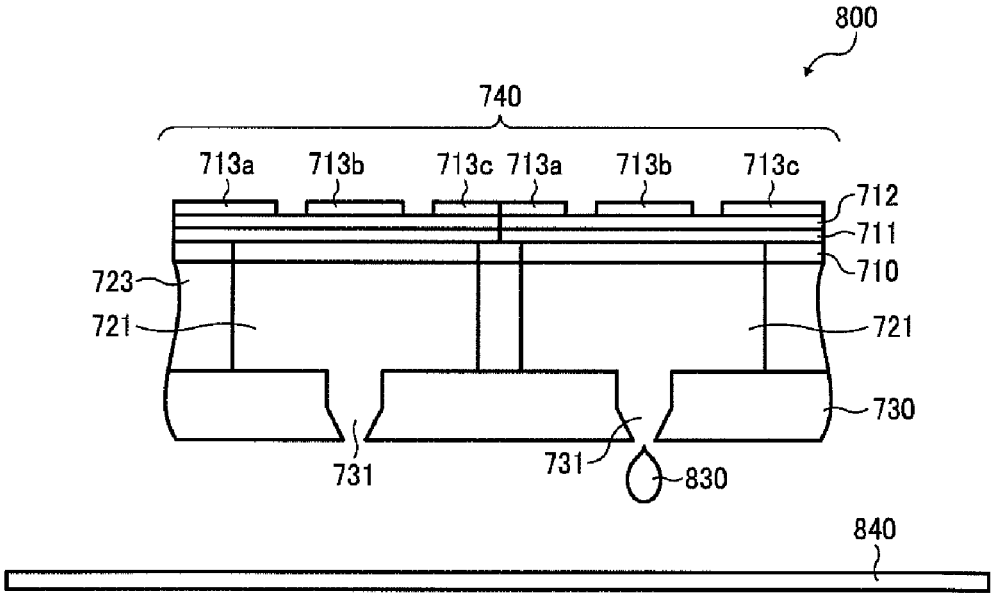
FIG. 28 is a schematic view illustrating a liquid-drop ejecting apparatus employing a liquid-drop ejecting head according to an illustrative embodiment.

FIG. 28 is a schematic view illustrating the liquid-drop ejecting apparatus 800 employing the liquid-drop ejecting head 700.

In the liquid-drop ejecting apparatus 800, a liquid such as ink is stored in liquid chambers 721 partitioned by separation walls 723 and a diaphragm 710 of the piezoelectric actuator 740. In each liquid chamber 721, a nozzle orifice 731 to eject ink is formed on a side opposite the diaphragm 710.

In the liquid-drop ejecting apparatus 800, when voltages are supplied to the piezoelectric element 712 via the lower electrode 711 and the upper electrode 713, the diaphragm 710 is bent, resulting in a change in the internal volume of the liquid chamber 721, and pressure generated by the volume change causes ink contained therein to be ejected as liquid drops 830 from the nozzle orifice 731. The liquid drops 830 adhere to a recording medium 840 to form an image on the recording medium 840.

Since the liquid-drop ejecting apparatus 800 employs the liquid-drop ejecting head 700, the diaphragm 710 can be greatly displaced at a low driving voltage compared to a conventional liquid-drop ejecting apparatus, increasing pressure on the liquid chamber 721. Accordingly, the liquid-drop ejecting apparatus 800 can eject ink at a relatively low driving voltage.

Further, the liquid-drop ejecting apparatus 800 may be employed in, for example, the image forming apparatus 81 illustrated in FIGS. 3 and 4. In such a case, in the recording unit 82 of the image forming apparatus 81, the liquid-drop ejecting apparatus 800 is disposed under the cartridges 95 and supported by the carriage 93. With such a configuration, by operating the liquid-drop ejecting apparatus 800 as described above, the image forming apparatus 81 can effectively eject ink at a relatively low driving voltage to form a desired image.

Numerous additional modifications and variations are possible in light of the above teachings. It is therefore to be understood that within the scope of the appended claims, the disclosure of the present invention may be practiced otherwise than as specifically described herein.

With some embodiments of the present invention having thus been described, it will be obvious that the same may be varied in many ways. Such variations are not to be regarded as a departure from the spirit and scope of the present invention, and all such modifications are intended to be included within the scope of the present invention.

For example, elements and/or features of different illustrative embodiments may be combined with each other and/or substituted for each other within the scope of this disclosure and appended claims.

What is claimed is:

1. A liquid drop ejecting head for ejecting liquid drops from nozzles communicating with liquid chambers, comprising:

a piezoelectric actuator including a diaphragm whose ends are fixed in a short-side direction of the diaphragm and plural active elements mounted on the diaphragm, each of the active elements being contractible and extendable by a supply of a voltage to displace the diaphragm in an out-of-plane direction, wherein the diaphragm is displaced with curvature so as to have a plurality of inflection points in the short-side direction, the plural active elements are disposed on the diaphragm without covering the inflection points, and at least one of the active elements is disposed on an area from a corresponding one of the ends of the diaphragm to a proximal inflection point of the inflection points in a cross-section in the short-side direction of the diaphragm to displace with curvature the area from the corresponding end of the diaphragm to the proximal inflection point toward the liquid chambers.

2. The liquid drop ejecting head according to claim 1, wherein the active element is a piezoelectric body comprising a first electrode layer, a piezoelectric layer on the first electrode layer, and a second electrode layer on the piezoelectric layer, and at least the piezoelectric layer is distributed among the plurality of inflection points of the diaphragm.

3. The liquid drop ejecting head according to claim 1, wherein the active element is a heat resistor, the diaphragm is made of a material of low thermal conductivity, and a member of high thermal conductivity is disposed between the diaphragm and the active element.

4. The liquid drop ejecting head according to claim 1 comprising a plurality of the active elements, wherein the respective active elements are disposed at portions of the diaphragm having identical in-plane extension and contraction characteristics.

5. The liquid drop ejecting head according to claim 1, wherein the active element is disposed at an area at which the diaphragm has a minimum curvature radius in the cross-section in the short-side direction of the diaphragm.

6. The liquid drop ejecting head according to claim 1, wherein the active element is disposed at each end of the diaphragm in a long-side direction of the diaphragm.

7. A liquid drop ejecting head, comprising:

a plurality of piezoelectric actuators including a deformable diaphragm of a substantially rectangular shape, a first electrode formed on a face of the diaphragm, a piezoelectric layer formed on a first face of the first electrode opposite a second face of the first electrode contacting the diaphragm, and a second electrode formed on a first face of the piezoelectric layer opposite a second face of the piezoelectric layer contacting the first electrode and divided into three portions in a cross section in a short-side direction of the diaphragm, a first common potential supplied to the first electrode of the plurality of piezoelectric actuators, a control potential supplied to a middle portion located between the other two portions of the three portions of the second electrode, a second common potential supplied to the other two portions, wherein the middle portion of the second electrode is formed on a middle piezoelectric element that is distinct from the piezoelectric elements on which the other two portions of the three portions of the second electrode are formed.

8. The liquid drop ejecting head according to claim 7, wherein, when the first common potential is a reference potential, each of the second common potential and the control potential differ from the first common potential, and the second common potential is supplied in synch with the control potential.

9. The liquid drop ejecting head according to claim 8, wherein an absolute value of the control potential is substantially identical to the second common potential.

10. The liquid drop ejecting head according to claim 7, wherein the three portions of the second electrode are formed on the piezoelectric layer so as to bracket inflection points of the diaphragm.

11. A liquid drop ejecting apparatus comprising a liquid drop ejecting head with a plurality of piezoelectric actuators, the plurality of piezoelectric actuators including a deformable diaphragm of a substantially rectangular shape, a first electrode formed on a face of the diaphragm, a piezoelectric layer formed on a first face of the first electrode opposite a first face of the first electrode contacting the diaphragm, and a second electrode formed on a first face of the piezoelectric layer opposite a second face of the piezoelectric layer contacting the first electrode and divided into three portions in a cross section in a short-side direction of the diaphragm, a first common potential supplied to the first electrode of the plurality of piezoelectric actuators, a control potential supplied to a middle portion located between the other two portions of the three portions of the second electrode, a second common potential supplied to the other two portions, wherein the middle portion of the second electrode is formed on a middle piezoelectric element that is distinct from other piezoelectric elements on which the other two portions of the three portions of the second electrode are formed.

12. The liquid drop ejecting apparatus according to claim 11, wherein, when the first common potential is a reference potential, each of the second common potential and the control potential differ from the first common potential, and the second common potential is supplied in synch with the control potential.

13. The liquid drop ejecting apparatus according to claim 12, wherein an absolute value of the control potential is substantially identical to the second common potential.

14. The liquid drop ejecting apparatus according to claim 11, wherein the three portions of the second electrode are formed on the piezoelectric layer so as to bracket inflection points of the diaphragm.

15. The liquid drop ejecting apparatus according to claim 11, wherein the control potential supplied to the middle portion located between the other two portions of the three portions of the second electrode displaces with curvature the diaphragm toward a side of the diaphragm opposite a side on which the piezoelectric layer is formed.

16. The liquid drop ejecting apparatus according to claim 11, wherein the second common potential supplied to the other two portions and the control potential supplied to the middle portion have same magnitude but opposite polarity.

17. The liquid drop ejecting apparatus according to claim 11, wherein when the control potential is supplied to the middle portion and the second common potential supplied to the other two portions of the three portions of the second electrode, extension and contraction directions of the middle piezoelectric element are opposite extension and contraction directions of the other piezoelectric elements.

* * * * *